US007526998B2

(12) United States Patent
Vasel et al.

(10) Patent No.: US 7,526,998 B2
(45) Date of Patent: May 5, 2009

(54) STABILIZED NON-LETHAL PROJECTILE SYSTEMS

(75) Inventors: Edward J. Vasel, San Diego, CA (US); Corey A. Fuzak, San Diego, CA (US)

(73) Assignee: PepperBall Technologies, Inc., San Diego, CA (US)

( * ) Notice: Subject to any disclaimer, the term of this patent is extended or adjusted under 35 U.S.C. 154(b) by 0 days.

(21) Appl. No.: 10/731,684

(22) Filed: Dec. 8, 2003

(65) Prior Publication Data

US 2005/0016412 A1 Jan. 27, 2005

Related U.S. Application Data

(60) Provisional application No. 60/446,657, filed on Feb. 10, 2003.

(51) Int. Cl.
*F42B 8/00* (2006.01)

(52) U.S. Cl. ..... 102/502; 102/532; 102/370

(58) Field of Classification Search ..... 102/502, 102/512, 513, 395, 334, 370, 532
See application file for complete search history.

(56) References Cited

U.S. PATENT DOCUMENTS 0,938,836 A 11/1909 Fessenden
1,302,272 A * 4/1919 Aoughsten ..... 102/370
1,461,600 A 7/1923 Cottrall
1,517,554 A 12/1924 Fulcher
1,920,257 A * 8/1933 Halland ..... 102/395
2,112,758 A 3/1938 Blacker
2,375,314 A 8/1945 Mills
2,614,633 A 10/1952 Broyles
2,625,764 A 1/1953 OBrien et al.
2,925,276 A 2/1960 Leclerc
2,986,072 A 5/1961 Hudson
3,053,185 A * 9/1962 Oberfell et al. ..... 102/532

(Continued)

FOREIGN PATENT DOCUMENTS

DE 4321041 1/1995

(Continued)

OTHER PUBLICATIONS

U.S. Appl. No. 10/208,727, filed Jul. 29, 2002, Vasel.

(Continued)

*Primary Examiner*—Michelle Clement
(74) *Attorney, Agent, or Firm*—Fitch, Even, Tabin & Flannery

(57) ABSTRACT

Projectiles and projectile systems are provided herein employing an inhibiting and/or marking substance for impairing/marking a living target. In some embodiments, the systems include a first part being non-spherical and having an exterior, a plurality of stabilizing fins secured with the exterior of at the first part, and a second part have a hollow portion containing an inhibiting substance, wherein the second part is sealed with the first part to seal the inhibiting substance within at least the hollow portion. The first part can similarly have a hollow portion such that a volume is defined by the hollow portion of the first part and the hollow portion of the second part, wherein the inhibiting substance is contained within the volume. The fins can be angled to provide spin stabilizing.

9 Claims, 19 Drawing Sheets

U.S. PATENT DOCUMENTS 3,279,318 A 10/1966 Vass et al.
3,419,274 A 12/1968 Tabor
3,528,662 A 9/1970 Merchant et al.
3,649,020 A 3/1972 Hall
3,650,213 A * 3/1972 Abbott et al. ..... 102/436
3,665,803 A 5/1972 Forsten et al.
3,707,793 A 1/1973 Holton, II
3,738,271 A * 6/1973 La Costa ..... 102/430
3,765,116 A 10/1973 Zaid
3,776,429 A 12/1973 DeLucia
3,791,303 A 2/1974 Sweeney et al.
3,848,532 A * 11/1974 Abbott ..... 102/517
3,865,038 A 2/1975 Barr
3,895,579 A 7/1975 Gawlick et al.
3,898,932 A 8/1975 Flatau et al.
3,911,824 A 10/1975 Bbarr et al.
3,921,614 A 11/1975 Fogelgren
3,951,070 A 4/1976 Flatau
3,983,817 A * 10/1976 Tucker ..... 102/513
4,016,666 A 4/1977 Finn et al.
4,153,927 A 5/1979 Owens
4,223,804 A 9/1980 Morris et al.
4,250,742 A 2/1981 Kopf
4,316,404 A 2/1982 Medlin
4,336,644 A 6/1982 Medlin
4,352,316 A 10/1982 Medlin
4,434,718 A * 3/1984 Kopsch et al. ..... 102/522
4,448,106 A * 5/1984 Knapp ..... 89/1.11
4,449,474 A 5/1984 Mariol
4,505,336 A 3/1985 Thevis et al.
4,560,168 A 12/1985 Aoyama
4,589,342 A * 5/1986 Rousseau ..... 102/377
4,634,606 A 1/1987 Skogg
4,656,092 A 4/1987 Haman et al.
4,684,137 A 8/1987 Armer, Jr. et al.
4,686,905 A 8/1987 Szabo
4,696,347 A 9/1987 Stolov et al.
4,856,218 A 8/1989 Reynolds, Jr.
4,895,076 A 1/1990 Looger et al.
4,899,660 A 2/1990 Brighton
4,932,329 A 6/1990 Logie
4,942,818 A 7/1990 Saxby
4,944,521 A 7/1990 Greeno
4,950,516 A 8/1990 Schwab
4,976,202 A 12/1990 Honigsbaum
4,979,747 A 12/1990 Jonkouski
4,998,368 A 3/1991 Blase
5,001,880 A 3/1991 Smith
5,009,164 A 4/1991 Grinberg
5,009,165 A 4/1991 Morris
5,018,449 A 5/1991 Eidson, II
5,018,450 A 5/1991 Smith
5,035,183 A 7/1991 Luxton
5,076,607 A 12/1991 Woods et al.
5,078,117 A 1/1992 Cover
5,217,708 A 6/1993 Pinkney
5,221,809 A 6/1993 Cuadros
5,225,628 A 7/1993 Heiny
5,254,379 A 10/1993 Kotsiopoulous et al.
D348,907 S * 7/1994 Prentice ..... D21/5
5,341,744 A 8/1994 Shi
5,353,712 A 10/1994 Olson
5,361,524 A 11/1994 Karkau et al.
5,361,700 A 11/1994 Carbone
5,365,913 A 11/1994 Walton
5,402,729 A 4/1995 Richert
5,446,985 A 9/1995 Chen
5,450,795 A 9/1995 Adelman
5,529,215 A 6/1996 Banks et al.
5,565,649 A 10/1996 Tougeron et al.
5,620,704 A 4/1997 Cade et al.
5,639,526 A 6/1997 Kotsiopolous et al.
5,640,945 A 6/1997 Slonaker et al.
5,671,559 A 9/1997 Ludaesher et al.
5,694,713 A 12/1997 Paldino
5,715,623 A 2/1998 Mackey, III
5,727,538 A 3/1998 Ellis
5,732,752 A 3/1998 Glessner et al.
5,750,918 A 5/1998 Mangolds et al.
5,762,963 A 6/1998 ByasSmith
5,791,327 A 8/1998 Riggs et al.
5,821,450 A * 10/1998 Fedida ..... 102/370
5,832,911 A 11/1998 Meyville et al.
5,882,036 A 3/1999 Moore et al.
5,893,483 A 4/1999 Duran
5,936,190 A * 8/1999 Buzick ..... 102/502
5,941,629 A 8/1999 Paldino
5,965,839 A 10/1999 Vasel et al.
5,997,667 A 12/1999 Jacobson
6,003,504 A 12/1999 Rice et al.
6,142,136 A 11/2000 Velasco
6,142,137 A 11/2000 McLaughlin
6,145,441 A 11/2000 Woodall et al.
6,209,461 B1 * 4/2001 Riffet et al. ..... 102/513
6,220,918 B1 * 4/2001 Laronge ..... 446/63
6,223,658 B1 5/2001 Rosa et al.
6,230,630 B1 5/2001 Gibson et al.
6,250,226 B1 * 6/2001 Leichter et al. ..... 102/370
6,302,028 B1 10/2001 Guillot Ulmann et al.
6,393,992 B1 5/2002 Vasel et al.
6,543,365 B1 4/2003 Vasel et al.
6,546,874 B2 4/2003 Vasel et al.
6,615,815 B1 9/2003 Liang
6,669,530 B2 12/2003 Du
2003/0047105 A1 3/2003 Vasel et al.
2004/0016048 A1 1/2004 Allenbaugh et al.
2005/0011507 A1 1/2005 Webb
2005/0066841 A1 3/2005 Vasel et al.

FOREIGN PATENT DOCUMENTS

WO WO 94/28371 12/1994
WO WO 95/00814 A1 1/1995
WO WO 99/14551 3/1999
WO WO 00/53999 9/2000

OTHER PUBLICATIONS

U.S. Appl. No. 10/382,295, filed Mar. 4, 2003, Vasel.
Christensen et al., Preliminary Investigation of Oleoresin Capsicum, *National Institute of Justice Report* 100-95, 1995, pp. 1-11.
Constant et al., "Nonivamide, a Constituent of Capsicum oleoresin", *J. Nat. Prod.*, 1996, pp. 425-426, vol. 59(4).
Reilly et al., Quantitative Analysis of Capsaicinoids in Fresh Peppers, "Oleoresin Capsicum and Pepper Spray Products", *Journal of Forensic Sciences*, 2001, pp. 502-509, 46(3).
Ingram, Carl, "Bill Would Let Public Buy New Pepper Weapon", *Los Angeles Times*, 2001, B1 and B11.
Punte, Charles, "Toxicologic Studies on o-Chlorobenzylidene Malononitrile" Army Chemical Research and Development Laboratories. Jan. 12, 1961.
Brentwood Health International, "Healthful Products for the Discriminating: What is Capsicum and what are it's possible Health Benefits?", http://www.emuhealthproducts.com/capsicum.html., printed on Apr. 2, 2003.
Patten Report Recommendations 69 and 70 Relating to Public Order Equipment: A Paper prepared by the Steering Group led by the Northen Ireland Office, Apr. 2001, p. 12. http://www.nio.gov.uk/pdf/phase1report.pdf.
Zarc International Inc., Cap-Stun OC Products: Oleoresin Extraction, http://www.zarc.com/english/cap-stun/techinfo/oc/oleoresin.html, printed on Apr. 2, 2003.
U.S. Appl. No. 10/953,055, filed Sep. 28, 2004, Vasel et al.
U.S. Appl. No. 11/102,297, filed Apr. 8, 2005, Vasel et al.
U.S. Appl. No. 11/129,230, filed May 12, 2005, Vasel et al.

Supplemental European Search Report, 90 098 a/fi, Feb. 25, 2005.
PCT Preliminary Report on Patentability for PCT/US2005/016657, International Bureau of WIPO, Mailing date Nov. 23, 2006.
PCT International Search Report for PCT/US04/03640, ISA/US, Mailing date Dec. 6, 2006.
"PCT Priliminary Report on Patentablity for PCT/US2005/016657 mail date Nov. 23, 2006". *International Bureau of WIPO*.
"PCT International Search Report, PCT/US2004/03640, ISA/US, mail date Dec. 12, 2006".
"Declaration of Scott Sutton in support of defendants'motion to dismiss plaintiff's complaint for patent infringement of United States patent Nos. 6546874 and 6543365", *Pepperball Technologies Inc. v. Security with Advanced Technology, Inc et.al., 07cv0672JAH(POR)*, Jun. 4, 2007.
"Declaration of Timothy R. Beyer in support of defendants' motion to dismiss plaintiff's complaint for patent infingement of United States patent Nos. 6546874 and 6543365", *Pepperball Technologies Inc. v. Security with Advanced Technology, Inc. et.al., 07cv0672JAH(POR)*, Jun. 4, 2007.
"Defendant's motion to dismiss plaintiff's complaint for patent infringement of United States patent Nos. 6546874 and 6543365", *Pepperball Technologies Inc. v. Security with Advanced Technology, Inc. et.al., 07cv0672JAH(POR)*, Jun. 4, 2007.
"First amended complaint for patent infringement and breach of contact", *Pepperball Technologies Inc. v. Security with Advanced Technology, Inc. et.al., 07cv0672JAH(POR)*, Jun. 26, 2007.
"Notice of defendants'request to withdraw motion to dismiss", *Pepperball Technologies Inc. v. Security-with Advanced Technology, Inc. et.al., 07cv0672JAH(POR)*, (Jun. 26, 2007).
"Defendant'request to withdraw motion to dismiss and vacate hearing", *Pepperball Technologies Inc. v. Security with Advanced Technology, Inc. et.al., 07cv0672JAH(POR)*, (Jun. 29, 2007).
"Defendants'answer, affirmative defenses, and counterclaims to first amended complaint", *Pepperball Technologies Inc. v. Security with Advanced Technology, Inc. et.al., 07cv0672JAH(POR)*, (Jul. 2, 2007).
"Notice of Defendants'motion to stay proceedings pending the resolution of the reexamination proceeding relating to United States patent Nos. 7194960 and 6393992", *Pepperball Technologies Inc. v. Security with Advanced Technology, Inc. et.al., 07cv0672JAH(POR)*, Jul. 2, 2007).
"Defendants'motion to stay proceedings pending the resolution of the reexamination proceeding relating to United States patent Nos. 7194960 and 6393992", *Pepperball Technologies Inc. v. Security with Advanced Technology, Inc, et.al., 07cv0672JAH(POR)*, (Jul. 2, 2007).
"Defendants'memorandum of points and authorities in support of their motion to stay proceedings pending the resolution of the reexamination proceeding relating to United States patent Nos. 7194960 and 6393992", *Pepperball Technologies Inc. v. Security with Advanced Technology, Inc. et.al., 07cv0672JAH(POR)*, (Jul. 2, 2007).
"Declaration of Fletcher W. Paddison in support of defendants'motion to stay proceedings pending the resolution of the reexamination proceeding relating to United States patent Nos. 7194960 and 6393992", *Pepperball Technologies Inc. v. Security with Advanced Technology, Inc. et.al., 07cv0672JAH(POR)*, (Jul. 2, 2007).
"Order granting defendants'request to withdraw motion to dismiss and vacate hearing", *Pepperball Technologies Inc. v. Security with Advanced Technology, Inc. et.al., 07cv0672JAH(POR)*, (Jul. 10, 2007).
"Pepperball's reply to defendants'first counterclaim (declaratory judgment)", *Pepperball Technologies Inc. v. Security with Advanced Technology, Inc. et.al., 07cv0672JAH(POR)*, (Jul. 24, 2007).
"Plaintiff Pepperball Technologies, Inc.'s notice of motion and motion to dismiss defendants'second counterclaim", *Pepperball Technologies Inc. v. Security with Advanced Technology, Inc. et. al., 07cv0672JAH(POR)*, (Jul. 24, 2007).
"Memorandum of points and authorities in support of plaintiff's motion to dismiss defendants'second counterclaim", *Pepperball Technologies Inc. v. Security with Advanced Technology, Inc. et.al., 07cv0672JAH(POR)*, (Jul. 24, 2007).
"Plaintiff Pepperball Technologies, Inc.'s opposition to defendants'motion to stay proceedings", *Pepperball Technologies Inc. v. Security with Advanced Technology, Inc. et.al., 07cv0672JAH(POR)*, (Aug. 30, 2007).
"Declaration of Eric P. Wenaas in opposition to defendants'motion to stay proceedings", *Pepperball Technologies Inc. v. Security with Advanced Technology, Inc. et.al., 07cv0672JAH(POR)*, (Aug. 30, 2007).
"Declaration of Christin Lewis in opposition todefendants'motion to stay proceedings", *Pepperball Technologies Inc. v. Security with Advanced Technology, Inc et.al., 07cv0672JAH(POR)*, (Aug. 30, 2007).
"Declaration of Stewart M. Brown in opposition to defendants'motion to stay proceedings", *Pepperball Technologies Inc. v. Security with Advanced Technology, Inc. et.al., 07cv0672JAH(POR)*, (Aug. 30, 2007).
"Defendants'response in opposition to plaintiff's motion to dismiss defendants'second counterclaim", *Pepperball Technologies Inc. v. Security with Advanced Technology, et.al., 07cv0672JAH(POR)*, (Aug. 31, 2007).
"Declaration of Fletcher W. Paddison in support of defendants'response in opposition to plaintiff's motion to dismiss defendant's second counterclaim", *Pepperball Technologies Inc. v. Security with Advanced Technology, Inc. et.al., 07cv0672JAH(POR)*, (Aug. 31, 2007).
"Defendants'reply in support of motion to stay proceedings", *Pepperball Technologies Inc. v. Security with Advanced Technology, Inc. et.al., 07cv0672JAH(POR)*, (Sep. 10, 2007).
"Declaration of Fletcher W. Paddison in support of defendants'reply in support of motion to stay proceedings", *Pepperball Technologies Inc. v. Security with Advanced Technology, Inc. et.al., 07cv0672JAH(POR)*, (Sep. 10, 2007).
"Reply memorandum of points and authorities in support of plaintiff's motion to dismiss defendants'second counterclaim", *Pepperball Technologies Inc. v. Security with Advanced Technology, Inc. et.al., 07cv0672JAH(POR)*, (Sep. 10, 2007).
"Plaintiff's objections to and motion to strike portions of the declaration of Scott Sutton in support of defendants'reply in support of motion to stay proceedings", *Pepperball Technologies Inc. v. Security with Advanced Technology, Inc. et.al., 07cv0672JAH(POR)*, (Sep. 11, 2007).
"Addendum to defendants'reply in support of motion to stay proceedings", *Pepperball Technologies Inc. v. Security with Advanced Technology, Inc. et.al., 07cv0672JAH(POR)*, (Oct. 3, 2007).
"Declaration of Fletcher W. Paddison in support of defendants'addendum to reply in support of motion to stay proceedings", *Pepperball Technologies Inc. v. Security with Advanced Technology, Inc. et.al., 07cv0672JAH(POR)*, (Oct. 3, 2007).
"Plaintiff's objection to and motion to strike addendum to defendants'reply in support of motion to stay proceedings" , *Pepperball Technologies Inc. v. Security with Advanced Technology, Inc. et.al., 07cv0672JAH(POR)*, (Oct. 4, 2007).
"Order denying plaintiff's motin to strike and granting plaintiff's rrequest to file a response to defendant's addendum", *Pepperball Technologies Inc. v. Security with Advanced Technology, Inc. et.al., 07cv0672JAH(POR)*, (Oct. 5, 2007).
"Plaintiff's response to addendum to defendants'reply in support of motion to stay proceedings", *Pepperball Technologies Inc. v. Security with Advanced Technology, Inc. et.al., 07cv0672JAH(POR)*. (Oct. 9, 2007).
"PCT International Search Report and the Written Opinion of the ISA for PCT/US05/11999", *ISA/US, mail date Sep. 13, 2007.*
*Office Action from 11691415 dated 08172007*(86845).
"Response to plaintiff's objections to and motion to strike portions of declaration of Scott Sutton in support of defendants'reply in support of motion to stay proceedings", *Pepperball Technologies Inc. v. Security with Advanced Technology, Inc. et.al., 07cv0672JAH(POR)*, (Sep. 13, 2007).
"Replacement Request for Ex Parte Reexamination from 10/866031 dated Jun. 10, 2004 (86905)", (Jun. 10, 2004).
"Order Granting Request for Ex Parte Reexamination from 90/008731 dated Sep. 24, 2007 (86905)".

"Replacement Request for Reexamination from 09/289258 dated Apr. 9, 1999 (86867)".

"Order Granting Request for Ex Parte Reexamination from 90/008728 dated Sep. 20, 2007 (86867)".

"Complaint for Patent Infringement and Breach of Contract", *Pepperball Technologies Inc. v. Security with Advanced Technology, Inc. et.al., 07cv0672JAH(POR)*, (Apr. 13, 2007).

"Notice of Defendants' Motion to Dismiss Plaintiff's Complaint for Patent Infringement of United States patent Nos. 6546874 and 6543365", *Pepperball Technologies Inc. v. Security with Advanced Technology, Inc. et.al., 07cv0672JAH(POR)*, (Jun. 4, 2007).

"Defendants' Memorandum of Points and Authorities in Support of their Motion to Dismiss Plaintiff's Complaint for Patent Infringement of United States patent Nos. 6546874 and 6543365", *Pepperball Technologies Inc. v. Security with Advanced Technology, Inc. et.al., 07cv0672JAH(POR)*, (Jun. 4, 2007).

Office Action from 11/129230 dated Aug. 3, 2007 (81496).

Patent Cooperation Treaty International Preliminary Report on Patentability issued in PCT/US04/003640 mailed Dec. 20, 2006 (81097).

Patent Cooperation Treaty Written Opinion of the International Searching Authority issued PCT/US04/003640 mailed Dec. 6, 2006 (81097).

Patent Cooperation Treaty International Search Report issued in PCT/US05/16657 mailed Jun. 27, 2006 (81497).

Patent Cooperation Treaty International Preliminary Report on Patentability issued in PCT/US05/16657 mailed Nov. 14, 2006 (81497).

Patent Cooperation Treaty Written Opinion of the International Searching Authority issued in PCT/US05/16657 mailed Jun. 27, 2006 (81497).

"Order Granting Defendants/Counter-claimants Motion to Stay and Denying Without Prejudice Plaintiffs' Motion to Dismiss"; Pepperball Technologies Inc. v. Security With Advanced Technology, Inc. et al.; Civil No. 07cv0672; Feb. 13, 2008.

* cited by examiner

STABILIZED NON-LETHAL PROJECTILE SYSTEMS

This application claims the benefit of U.S. Provisional Application No. 60/446,657, filed Feb. 10, 2003, incorporated herein by reference.

FIELD OF THE INVENTION

The present invention relates to a non-lethal projectile system and, more particularly to non-lethal projectiles that deliver an inhibiting and/or marking substance to a target, especially a living target.

BACKGROUND OF THE INVENTION

Steadily rising crime rates have led to an increased need for technologically enhanced crime devices. There is particularly a need for non-lethal devices that are capable of at least temporarily incapacitating, slowing or inhibiting a suspected criminal and/or marking such individuals for later identification. As populations increase, the risk that a criminal will be surrounded by or in close proximity to innocent persons when officers are trying to subdue him/her also increases. Whereas non-permanently injuring an innocent bystander, while subduing a suspected criminal, is acceptable, killing the bystander is not. Thus, there is great need for non-lethal (or less-than-lethal), highly effective weapons that may be used by officers and others to slow, stop and/or mark criminals. Presently available, non-lethal devices include, for example, stun guns, mace, tear gas, pepper spray devices and similar devices that impair the vision, breathing or other physical or mental capabilities of the target.

One attempt to provide a non-lethal device for delivering an inhibiting substance is shown in U.S. Pat. No. 3,921,614, issued to Fogelgren for a COMPRESSED GAS OPERATED GUN HAVING VARIABLE UPPER AND LOWER PRESSURE LIMITS OF OPERATION, which patent is incorporated herein by reference in its entirety. Fogelgren describes a gas-operated gun and associated projectiles. In one illustrated embodiment, a projectile consists of a projectile casing that houses a structure in which a firing pin is situated so as to detonate a primary charge upon impact of the projectile with a target. Deterioration of the primary charge causes the expulsion of a load carried in a load chamber. The load chamber may contain various types of load, such as tear gas, dye, flash-powder or wadding.

Disadvantageously, the projectiles described by Fogelgren, particularly those projectiles described that would be suitable for delivering loads such as tear gas or dye, are complicated and expensive to manufacture. The embodiment employing pressurized gas to both expel the projectile and to expel the load upon impact with the target requires a great amount of pressurized gas, that is, a sufficient quantity to both fire the projectile and to provide the portion of pressurized gas necessary to ensure expulsion of the load. In addition, such embodiment requires complicated and tedious methods to manufacture components such as a microminiature ball valve (through which the portion of the pressurized gas enters the rear chamber upon firing), wax sealer within each of the plurality of apertures and a holding pin that must fall away from the projectile in flight.

The embodiment employing the breakable glass vial is also complicated to manufacture, because it also employs a holding pin that must fall away during the flight of the projectile and employs numerous structures that must be precisely fitted together to allow them to separate during firing and in flight.

This embodiment also must be carefully handled so that the breakable glass vial does not shatter while being handled by the user. This can be particularly problematic, for example, when the Fogelgren device is being used by a police officer in pursuit of a fleeing criminal (or when used by a police officer threatened by a suspected criminal). Thus, significant room for improvement still exists in the development of non-lethal projectiles.

Another approach to providing non-lethal projectiles for delivering an inhibiting substance to a living target is suggested in U.S. Pat. No. 5,254,379, issued to Kotsiopoulos, et al., for a PAINT BALL, which patent is hereby incorporated herein by reference in its entirety. The Kotsiopoulos, et al., device is directed primarily to a paint ball projectile for delivering a load (or blob) of paint to a target, and for expelling the blob of paint onto the target upon impact. The paint ball shown by Kotsiopoulos, et al. consists of a shell that fractures in a predetermined pattern upon impact with a target.

The Kotsiopoulos, et al. disclosure includes a passing reference to the use of such a paint ball for delivering dyes, smoke or tear gas to a target, however, provides no mechanism for dispersing an inhibiting load upon explosion of the projectile, which is important for a non-lethal inhibiting projectile to be effective. Specifically, when the Kotsiopoulos, et al. projectile impacts the target, by-design, the load is dispersed rather locally. Thus, even if one skilled in the art were to act upon the passing reference to using tear gas in the Kotsiopoulos, et al. patent, to using tear gas, the present inventors believe that such a device would be generally ineffective because the tear gas would not be dispersed to the target's face, where it needs to be to be effective.

Furthermore, as Kotsiopoulos, et al. is an unpressurized projectile, the amount of tear gas delivered would necessarily be limited to an unpressurized volume having dimensions of a paint ball. Even if this amount of tear gas were delivered to a target's face, it is unlikely that this amount of tear gas would be sufficiently effective to impair the target in a useful way.

Still other non-lethal projectiles are described, for example, in U.S. Pat. No. 5,009,164, issued to Grinberg (Apr. 23, 1991), U.S. Pat. No. 5,221,809 issued to Cuadros (Jun. 22, 1993) and U.S. Pat. No. 5,565,649, issued to Tougeron, et al. (Oct. 15, 1996), each of which is hereby incorporated by reference in its entirety. Grinberg describes a projectile that changes its shape upon impact with a target, thereby reducing the danger of penetration into a live target. For example, Grinberg uses a double leaf construction to facilitate rupture of the projectile upon impact. Cuadros describes a projectile that increases in size either during flight or upon impact to spread its force over a large area to provide a knock-down effect without body penetration, and Tougeron, et al., describe a self-propelled projectile intended to deliver an active substance to a living target.

While each of the devices described by these patents attempts to provide a projectile that may be used to stop or slow a living target without causing lethal injury, all of the devices have proven to be less than ideal. They are complicated and expensive to manufacture, and they are variously difficult to use and unreliably effective. As a result of these problems and others, there is no widely commercially accepted non-lethal projectile in use by law enforcement or military personnel today that delivers an inhibiting substance to a target.

As such, there is a need for a reliable and cost effective non-lethal devices and/or method for delivering non-lethal force.

SUMMARY OF THE INVENTION

The present invention advantageously addresses the above-identified needs, as well as other needs, by providing a non-lethal or less-than-lethal projectile system for delivering a substance to a target, especially a living target, such as a human or animal target. In some embodiments, the projectile system is better maximizes its effectiveness by providing a kinetic impact against the target at a first location on or near the target combined with a more optimum dispersement of the substance on and/or about the target at a second location.

In one embodiment, a system is provide that can comprise a first part have a hollow portion containing an inhibiting substance, a second part being non-spherical and having an exterior, wherein the first part is sealed with the second part to seal the inhibiting substance within at least the hollow portion, and a plurality of stabilizing fins secured with the exterior of at the second part. The second part can additionally include a hollow portion such that a volume is defined by the hollow portion of the second part and the hollow portion of the first part, wherein the inhibiting substance is contained within the volume. Further, the second part has a length and the first part has a width, where the length of the second part is greater than one and a half times the width of the first part. In some embodiments, the plurality of fins are angled relative to an axis of the second part such that the angled fins provide a spin stabilizing effect.

In some embodiments, a projectile system is provided for use in delivering a substance to a target. The projectile system can include a projectile that has a first part that is at least partially hollow, a second part that is secured with the first part such that the hollow portion is sealed, wherein the projectile is non-spherical, an inhibiting substance sealed within at least the hollow portion of the first part, and stabilizing fins secured with the second part along an exterior of the second part. Further, the inhibiting substance is dispersed into a cloud upon impact of the projectile with a target. In some embodiments, the projectile system further comprises a cartridge coupled with the second part wherein the cartridge includes means for launching the projectile.

In some embodiments, the second part of the projectile is at least partially hollow where the hollow portion of the second part cooperates with the hollow portion of the first part defining a volume within the first and second parts, and the inhibiting substance is sealed within the volume. The first part can additionally be frangible such that the inhibiting powder is radially dispersed when the projectile contacts the target.

Some embodiments provide a system that comprises at least one fin and a frangible portion housing a payload. The system, in some embodiments, can further comprise a generally non-frangible nose section. The payload includes irritant powder, an inert substance for training, a Capsaicin, Capsaicin II, at least one capsaicin, Oleoresin Capsaicin (OC), at least one of CS and CN, maloderants, a liquid substance a marking substance and/or a weighting substance.

In further embodiments, a system is provided that comprises at least one stabilizing fin, means for launching containing compressed gas, and a frangible portion housing at least a portion of a dispersible payload. The system can further include a shock absorbing nose section. Some embodiments provide a projectile system that includes at least one stabilizing fin, a frangible portion housing at least a portion of a dispersible payload, and a cartridge coupled with the frangible portion, wherein the cartridge includes means for launching the frangible portion. A flexible nose section can additionally be included.

A projectile system is provided through some embodiments that include means for spin stabilizing, and a frangible portion encasing at least a portion of a dispersible payload. The system, in some embodiments, can further include a cartridge coupled with the frangible portion, wherein the cartridge includes means for launching the frangible portion.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION

The following description of the presently contemplated best mode of practicing the invention is not to be taken in a limiting sense, but is made merely for the purpose of describing the general principles of the invention. The scope of the invention should be determined with reference to the claims.

As used herein, the term "projectile system" or "projectile" or "non-lethal projectile" refers generally to the entire projectile apparatus of the various embodiments of the present invention that travels to the target. For example, in all embodiments contemplated herein, the projectile system or projectile at least includes a projectile body that contains a substance for delivery to the target. For example, this projectile body may be embodied as a capsule having a hollow volume within that contains the substance. The terms "capsule", "casing" and "shell" are used interchangeably herein to refer to an embodiment of the projectile body as being a container portion of the projectile system within which the substance is contained, whether or not a deliverable substance is actually contained therein. This projectile body may be a variety of shapes, for example, the projectile body may be oblong, spherical or other shapes depending on the specific embodiment. In some embodiments, the projectile includes stabilizers or other aspects to provide a straighter or more accurate flight path. In some embodiments, the projectile body may be embodied as a stabilizer body, for example, which apparatus travels to the target.

Figure 1:
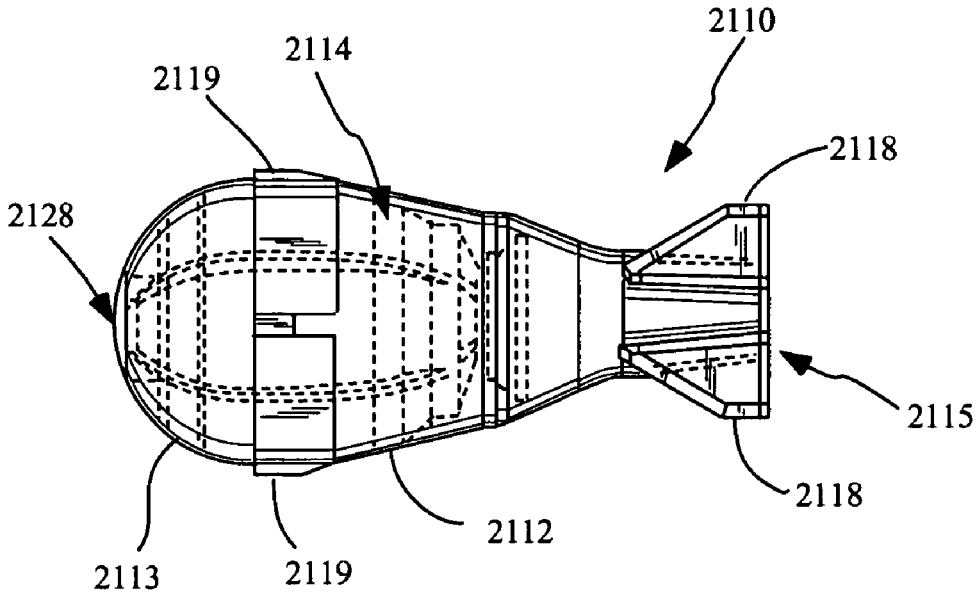
FIG. 1 is a partially transparent, side view showing a projectile for delivering a substance to a target.
Figure 2:
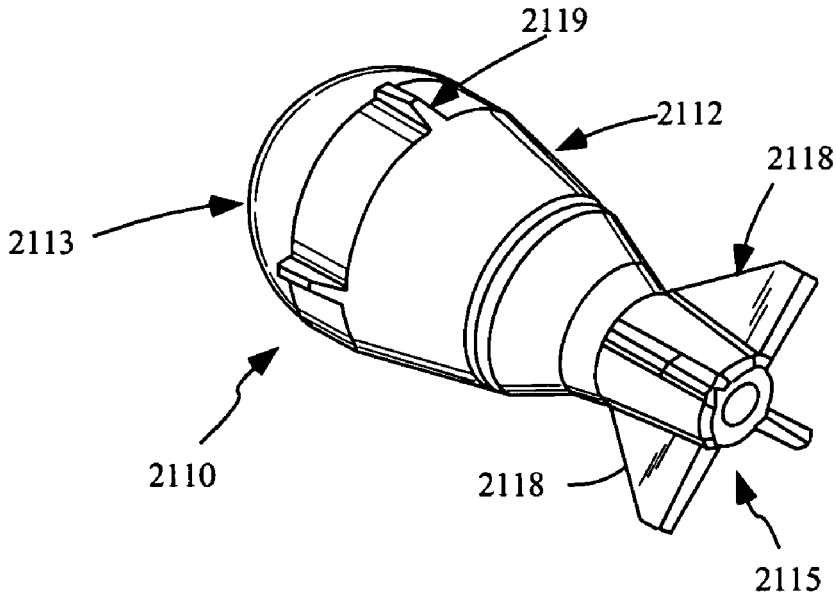
FIG. 2 shows an elevated rear view of the projectile of FIG. 1.

Referring now to FIGS. 1 and 2, where FIG. 1 is a partially transparent, side view showing a projectile 2110 (also referred to as a projectile system) for delivering a substance, for example, an irritant powder, an inhibiting liquid or powder substance, such as, a capsaicinoid, a plurality of capsaicinoids, pepper spray, oleoresin capsicum, Capsaicin, Capsaicin II, Oleoresin Capsaicin (OC), tear gas (e.g., CS and CN), malodorant, marking substance, water, baby powder, talcum powder, weighting substance, inert substance for training, and the like, to a living or inanimate target, such as a human target, in accordance with one embodiment of the present invention.

FIG. 2 shows an elevated rear view of the projectile 2110. The projectile system 2110 includes a projectile body 2112 and a nose 2113. In some embodiment, the nose 2113 includes a lid 2128 that fits into a fill hole (see FIG. 23) for filling the projectile with the substance. In some embodiments, the projectile 2110 includes stabilizers or other aspects, such as fins 2118 and other stabilizers 2119, to provide a more accuracy flight path. The body and nose form an internal cavity 2114 (see FIG. 3). The cavity is configured to hold or contain the payload or substance, such as inhibiting, marking or inert substances, to be delivered to the target.

Figure 3:
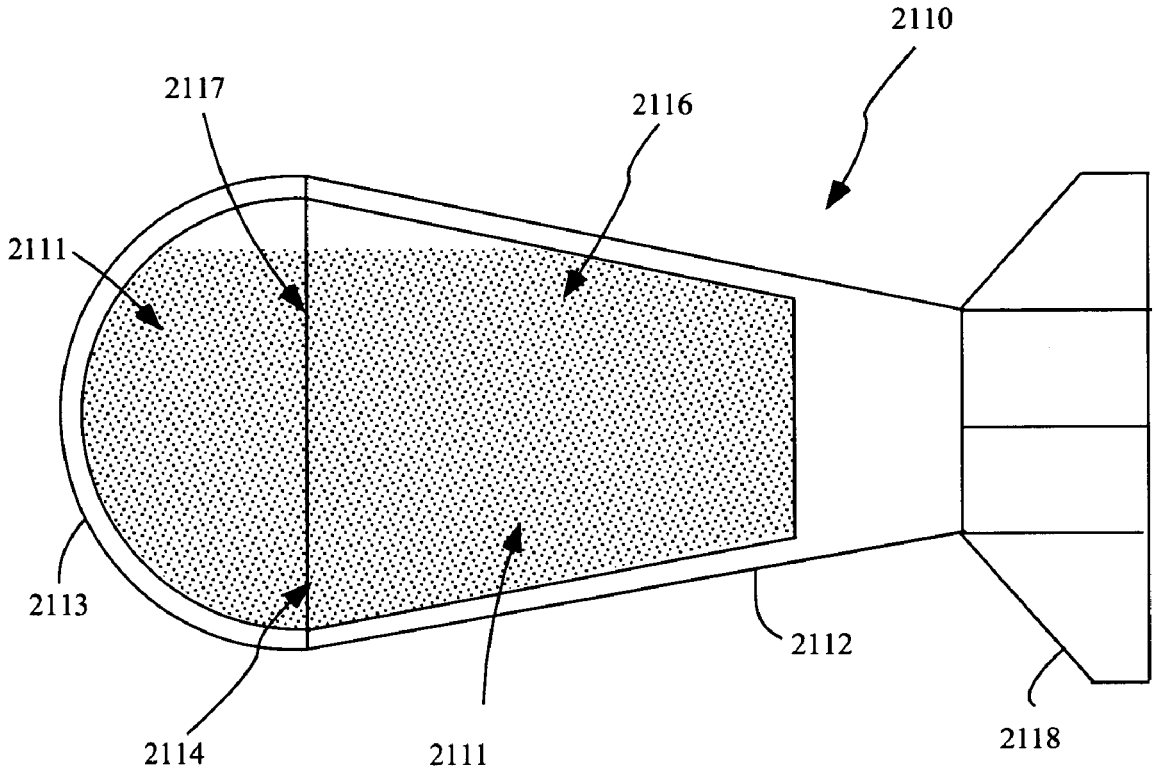
FIG. 3 depicts a cross-sectional view of the projectile system of FIGS. 1 and 2.

FIG. 3 depicts a cross-sectional view of projectile system 2210 according to one embodiment of the present invention showing the cavity 2114 holding or containing the payload substance 2111 to be delivered to the target. Upon impact with the target, the substance 2111 is dispersed at and about the target, thereby inhibiting, repelling, and/or marking the target. In a preferred embodiment, the projectile nose 2113, and in some embodiments the body 2112, ruptures upon impact with the target dispersing the substance 2111, and the substance 2111 contains an inhibiting substance, repelling substance and/or marking substance.

The inhibiting substance can comprise finely powdered capsaicinoid, a combination of a plurality of finely powdered capsaicinoids, oleoresin capsicum (such as may be purchased from Defense Technology of America in Casper, Wyo. (for example, Blast Agent oleoresin capsicum 943355, Cas. No. 8023-77-6, #T14, #T16, #T21 and/or #T23)), other pepper derivatives or other inhibiting substances.

Oleoresin capsicum (OC), a pepper substance, contains one or more active ingredients or capsaicinoids primarily responsible for the inhibiting or irritant effects including capsaicin, dihydrocapsaicin, nordihydrocapsaicin, homocapsaicin, homodihydrocapsaicin and pelargonic acid vanillylamide (PAVA), also known as nonivamide. Capsaicinoids are naturally occurring or synthetically reproduced, for example, one form of Oleoresin capsicum includes a synthetically produced version of nonivamide. Individual capsaicinoids function similarly to a collection of capsaicinoids. Oleoresin capsicum functions as an inhibiting substance due to the presence of one or more capsaicinoids. Oleoresin capsicum may be processed into a liquid, an oil, or a powder fill material. A capsaicinoid or capsaicinoids derived or extracted from naturally occurring oleoresin can be used, or a synthetic capsaicinoid or capsaicinoids can be used.

In the present embodiment, the oleoresin capsicum powder, to be used for the substance 2111, in some embodiments, (referred to with respect to the present embodiment as "powder") is preferably purchased at a concentration of about 0.05%, e.g., between 0.1% and 30%, e.g., 0.3% and 15%, e.g. about 5% by weight. Thus, the substance should be, for example, at least 0.5% oleoresin capsaicin by weight, more preferably at least 3%, and most preferably at least 5% by weight.

Alternatively, in terms of capsaicin, the powdered inhibiting substance should comprise at least 0.1% capsaicin by weight to be effective, preferably at least 0.5% capsaicin, most preferably about 1% capsaicin. In either case, the powder may be diluted, to a desired concentration, by mixing with an inert powdered substance, such as talcum, corn starch, baby powder or other inert substances.

Thus, in the broadest sense, in some embodiments, the inhibiting substance can in part comprise a pepper-derived powder substance, including for example, one or more of oleoresin capsicum, capsaicin I or II, dihydrocapsaicin, nordihydrocapsaicin, homocapsaicin, homodihydrocapsaicin, Nonivamide, PAVA, or combinations of the above pepper or pepper-derived substances.

Furthermore, in the powdered embodiments, it is advantageous that the substance 2111 is a finely ground powdered substance such that the particle sizes or grain are less than 1000 microns in diameter, and preferably less than 500 microns, more preferably less than 100 microns, and most preferably less than 50 microns. It has been found that the generally the smaller the particle diameter in a powdered substance, the more effective the radial dispersal of the substance upon impact and the larger the volume of the dispersal providing a "cloud-like" dispersion.

For example, particle diameters above 500 microns and specifically above 1000 microns, tend to simply splatter, spray, or scatter on the target and/or quickly fall to the ground. Furthermore, particle diameters generally above 250 microns and above 500 microns are easily prevented from entering a targets nostrils or mouth by placing a handkerchief there against. Furthermore, a powdered substance having, for example, a particle size of greater than 500 microns, or greater than 1000 microns, may only disperse into a very small volume, whereas a finely ground powdered substance will create a cloud of a much larger volume.

It is preferable to produce a "cloud" of the powdered substance to disperse radially and envelop a relatively large volume upon impact with the target and rupture of the nose 2113 and/or body 2112, for example, a cloud that is formed when clapping erasers together. As will be seen, it is advantageous that the substance produce a fine cloud of the powdered substance such that the cloud will be dispersed on and about the target, such that the target inhales the substance.

In some preferred embodiments, the substance comprises a powdered capsaicinoid powder, oleoresin capsicum powder or capsaicin powder that has an average particle size of less than 500 microns, preferably less than 100 microns, more preferably less than 50 microns, and most preferably less than 20 microns, e.g. 8 microns in diameter. Thus, when such powder is contained within projectile 2110, such as shown in FIGS. 1-3, which may be large enough to fit into a twelve-gauge shotgun shell casing, the nose 2113 and/or body 2112 ruptures upon impact with a target, producing a cloud of finely powdered substance 2111.

The projectile can be designed to produce a cloud of desired size. The size of the cloud produces depends on the size of the projectile 2110, the size of the cavity 2114, the particle size of the substance 2111, the speed of impact and other similar factors. In some embodiments, the size of the cloud is about 1 foot in diameter, and preferably about 2 feet or more in diameter. This cloud advantageously "wafts" in the air for several seconds, for example, between 6 and 10 seconds before settling, allowing sufficient time to inhale the powdered substance.

Furthermore, and advantageously, the powdered inhibitor substances, such as capsaicinoids, oleoresin capsicum and capsaicin, are more than topically acting substances. These substances react internally by entering the mouth and nostrils of the target and contacting the lung tissue, for example, causing a temporary irritation, choking, coughing, panic and/or feeling of inability to breathe, whereby the target is inhibited.

In other embodiments, the projectile 2110 may also be used to deliver other substances such as marking substances, including for example, dyes or paint, or the like, to a living or an inanimate target, and may also be used to deliver inert substances, such as, baby powder, corn starch, talcum powder, water and other inert substances. Such dyes may be colored dyes, such as those found in common paint ball technologies, or may contain other markers, such as an inferred, ultraviolet (UV) or glow-in-the-dark marker, which may be useful for marking a suspect at night, making it easier for law enforcement personnel to see the marked suspect at night. In one embodiment of a marking substance, a chemical marker or chemical fingerprinted paint, such as produced by Yellow Jacket, Inc. of California, can be used which effectively leaves a chemical ID or chemical fingerprint on the target, which can be used by the police to verify that a person was struck by a specific non-lethal projectile and place the suspect at a crime scene. As such, the chemical marker includes a chemical ID formulated into the paint substance during manufacture, identifying the batch of the chemical marker. For example, a fleck of the chemical marker found on a suspect two weeks after the being impacted with the chemical marker, can be chemically identified and traced to the shooter; thus, the suspect may be linked to a crime scene by the chemical marker.

Furthermore, chemical compounds having a particularly offensive odor, i.e. malodorants, may be contained within the projectile 2110, to be used to mark suspects by scent or to repel or keep people away from desired areas. In still further embodiments, the projectile may be used to deliver both inhibiting and marking substances, or even inert substances to the target.

Still referring to FIGS. 1-3, in accordance with the present embodiment, the substance 2111, such as an inhibiting substance, is encapsulated within a plastic, gelatinous or similar material projectile body 2112 and/or nose 2113. The body 2112 and/or nose 2113 may be made from various known substances, such as acrylic, vinyl, plastic, polystyrene and/or other polymers, sodium alginate, calcium chloride, coated alginate and/or polyvinyl alginate (PVA). Furthermore, the nose 2113 may be generally hemispherical or parabolic or have other desirable shapes according to the specific embodiment; however, some nose shapes may provide for better dispersal of the substance contained within upon impact. Additionally, the nose 2113, a body section or the whole projectile, may be made out of colored materials or even glow-in-the-dark materials to enhance the night time use of such projectiles and the color code helps to differentiate the types of projectiles for easy and safe identification by the use.

Similarly, the body 2112 can generally taper, may be generally oblong, be shaped similar to "A-bombs", or have another desirable shapes according to the specific embodiment; however, some body shapes may provide for more stable flight paths and/or more desirable dispersal of the substance contained within upon impact. In some embodiments, the body includes fins 2118 and/or other stabilizers 2119 to provide added stability during flight. The projectile 2110 can include substantially any number of fins. For example, the projectile shown in FIGS. 1 and 2 and include four fins 2118. Some embodiments include from zero to eight fins or more. Additionally, the body 2112 may be made out of colored materials or even glow-in-the-dark materials to enhance the night time use of such projectiles and the color code helps to differentiate the types of projectiles for easy and safe identification by the use.

Still referring to FIGS. 1-3, in one preferred embodiment, the projectile systems contemplated herein include a generally hemispherical hollow nose 2113, preferably formed of a polymer substance, for example and without limitation, polystyrene, polyvinyl, vinyl or acrylic. In one embodiment, the nose is configured to be generally non-frangible. Further, the nose can be configured to absorb some of the shock of impact with the target. For example, the nose can be formed of a non-frangible rubber, preferably a soft rubber, gelatin or other soft material, with the body being frangible. As such, the body breaks upon impact dispersing the substance. Alternatively, the nose can be formed of a hard, generally non-frangible material, as opposed to rubber, gelatin or other soft material, that receives the force of the impact while the body is frangible and breaks upon impact. Preferably, the outer diameter of the spherical nose 2113, or shell, is from between about 1.0 cm and 5.0 cm, e.g., 1.8 cm. In some embodiments, the outer diameter of the nose is less than an inner-diameter of a shotgun shell (see FIGS. 4-5) so that the nose 2113 fits into the shotgun shell. The inner-diameter of the nose 2113 (which defines part of the volume in which the substance 2111 is carried) preferably has a diameter of from between about 0.3 cm and 5.0 cm, e.g., 1.7 cm. The inner diameter can be substantially any size to provide a projectile that can deliver a desired payload to the target.

The projectile systems 2110 contemplated according to one embodiment herein further includes a generally tapering, hollow body 2112. The body can be formed from plastic, PVC, polymer substances, or other materials and/or combinations of these materials. The body is at least partially hollow or includes a bore, well or chamber 2116. The hollowed portion 2116 typically also tapers similar to the tapering of the body 2112. The mouth 2117 of the hollowed portion is positioned proximate the nose 2113. However, the hollow portion can be formed in substantially any configuration depending on any number of considerations, including, but not limited to, dimensions of the projectile, dimensions of the body, the amount of substance to be delivered, the weight of the substance, the desired center of gravity, the desired flight path, dispersment of the substance at the target and other similar factors.

The body 2112 has an outer diameter at the mouth 2117 that is preferably from between about 1.0 cm and 5.0 cm, e.g., 1.8 cm. Typically, the outer diameter is configured to have a diameter substantially equal to the diameter of the nose 2113. Further, the outer diameter of the body, in some embodiments, is less than the inner-diameter of a shotgun shell (see FIGS. 4-5) so that the nose 2113 and body 2112 fit into the shotgun shell.

The projectile 2110 can be designed and configured to have substantially any outer diameter to deliver substantially any amount of payload at the target. The diameter is limited only by the means for propelling and/or delivering the projectile at or near a target. For example, the projectile can have a diameter from less than 0.5 mm to greater than 10 cm. For example, projectiles can have diameters of about 5.56 mm, 7.62 mm, 9 mm, 10 mm, 11.4 mm, 14.5 mm, 20 mm, 25 mm, 30 mm, 37 mm, 40 mm, 63.5 mm, 76 mm, 105 mm, 127 mm, 155 mm, 1.7 cm, 5.0 cm and other similar diameters that correspond with the size of existing ammunition for various existing weapons. Similarly, the total length of the projectile can have substantially any length to achieve the desired flight stability and deliver a desired payload. In some embodiments, for example, the projectile can have lengths between less than 0.5 inches and over 65 inches.

The body tapers to reduce the weight of the projectile, maintain a preferred center of gravity and optimizes preferred flight path. The tail 2115 is designed to have a length and diameter large enough to provide stability, maintain desired fin rigidity and achieve the desired center of gravity. The fins 2118 and stabilizers 2119 enhance flight stability and thus accuracy. In some embodiments, the span across two fins and the tail is equal to or less than the outer diameter of the body 2112 and/or nose 2113.

The inner-diameter of the hollowed portion 2116 (which defines part of the volume in which the substance 2111 is carried) preferably tapers. The diameter of the mouth 2117 of the hollow portion 2116 is from between about 0.5 mm to greater than 10 cm. For example, the mouth diameter can be between 0.3 cm and 5.0 cm, e.g., 1.7 cm, and it typically about equal with the inner diameter of the nose 2113.

The cavity 2114 formed between the inner hollow of the nose and the hollow portion 2116 of the body 2112 houses or retains the substance to be delivered, and preferably dispersed, at a target. In preferred embodiments described in detail herein, the cavity 2114 is filled to at least about 30%, preferably 40% to less than 100%, more preferably 85% to 95%, and most preferably to about 90%, of its volume with a substance, for example an inhibiting, inert and/or marking substance, to be delivered to the target, for example a human target.

Because of the length of the body 2112, the hollow portion is typically configured with a volume greater than the volume of the nose 2113. This allows the projectile to carry and thus deliver a greater amount of substance, such as an inhibiting substance, to the target. Typically, the hollow portion 2116 of the body has a greater volume than spherical structures of previous devices, such as paint balls (e.g., those paint balls discussed in U.S. Pat. No. 5,254,379 (Kotsiopoulos et al.)).

The body 2112 is typically designed with a length greater than the radius of the hemispherical nose 2113. The body is more preferably greater in length than the diameter of the mouth 2117. In some preferred embodiments, the body is greater in length than one and a half times the diameter of the mouth 2117.

Figure 4:
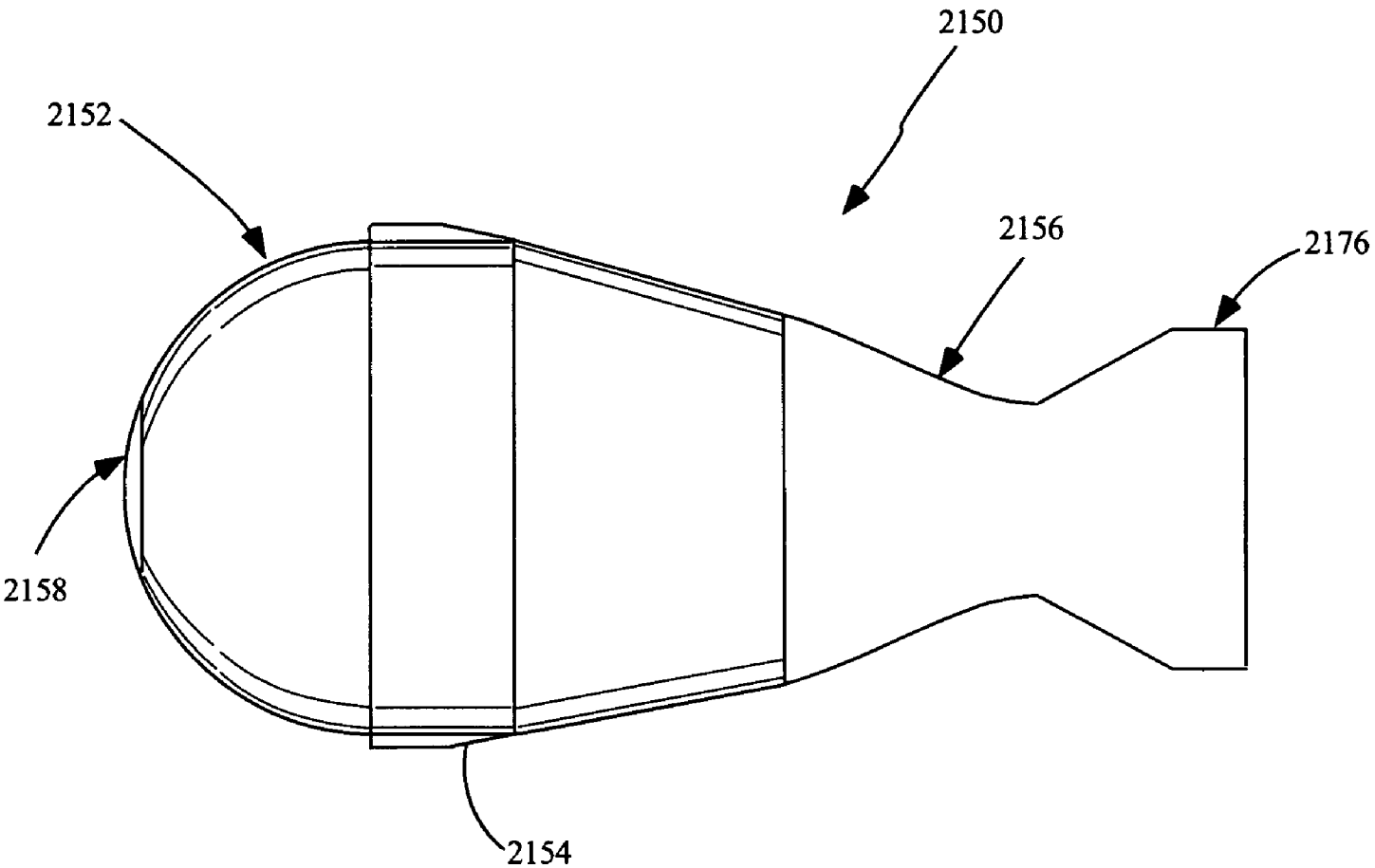
FIG. 4 illustrates a side view of a multi-piece projectile.

Referring to FIG. 4, illustrated is a side view of a multi-piece projectile 2150 according to one embodiment of the present invention. The projectile 2150 includes a nose 2152, a body 2154 and a tail 2156. In some embodiments the nose additionally includes a fill hole 2162 (see FIGS. 5-6) with a lid 2158 secured with the nose to retain the substance within the projectile 2150. The nose, body and tail are secured together to form the projectile 2150. As described above in relation to FIGS. 1-3, the nose 2152 and body 2154 have hollowed portions for receiving and retaining a payload, such as an inhibiting and/or inert substance, to be delivered to a target.

In some embodiments, the nose and body, the nose and lid, and the body and tail are secured together. Preferably the nose and body are additionally sealed to one another, such as using ultrasonic welding techniques, using an appropriate solvent or glue, by snapping the nose and body together or other similar techniques, such as combinations of these techniques. In some embodiments, the nose 2152 and body 2154 are also preferably sealed, such as using ultrasonic welding techniques, using an appropriate solvent or glue, or by snapping the nose and body together, such as combinations of these techniques.

Figure 5:
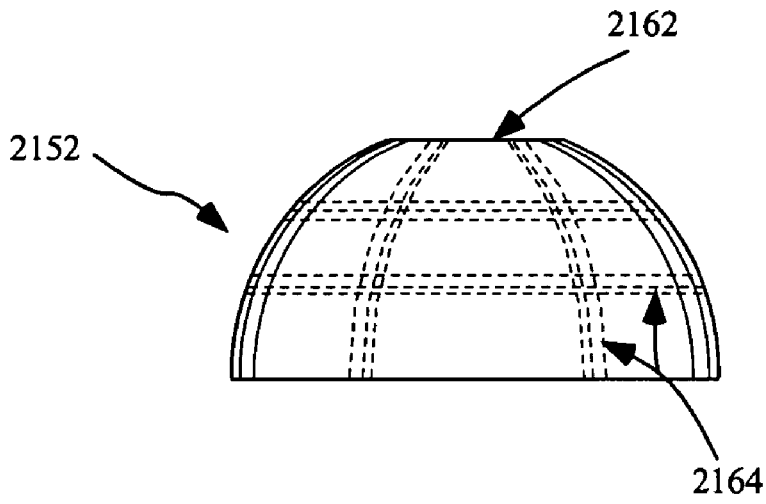
FIG. 5 depicts a cross-sectional view of a nose of the projectile of FIG. 4.
Figure 6:
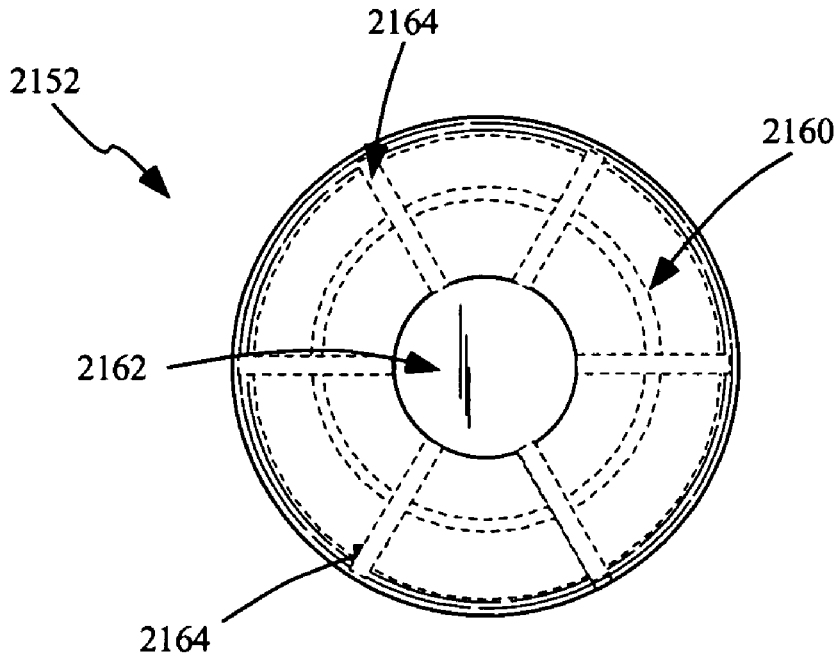
FIG. 6 depicts an elevated view of the internal hollow portion of the nose of FIG. 5.

Referring to FIGS. 5 and 6, where FIG. 5 depicts a cross-sectional view of a nose 2152, and FIG. 6 depicts an elevated view of the internal hollow portion 2160 of the nose 2152 according to one embodiment of the present invention. The nose 2152 includes the fill hole 2162 that allows the projectile to be filled with the substance after the projectile is assembled. The nose is shown with weakening or fracture points 2164, for example, interior scoring that run both longitudinal and latitudinal.

Figure 7:
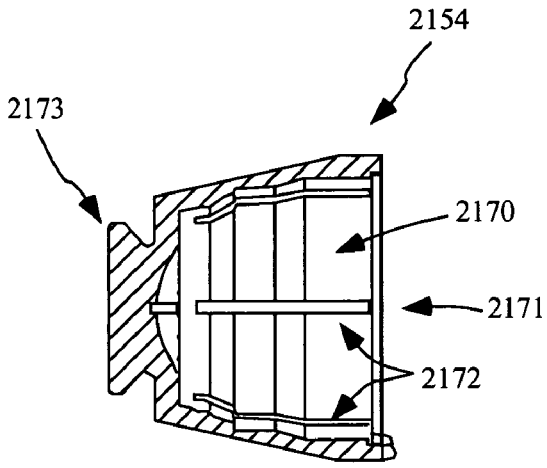
FIG. 7 shows a cross-sectional view of the body of FIG. 4.

One implementation of the body 2154 is shown in FIGS. 7-11. FIG. 7 shows a cross-sectional view of the body 2154. The body includes a hollow portion 2170. In some embodiments, the wall of the hollow portion tapers similar to the body, and in some embodiments is generally parabolic in shape. The body 2154 includes a male snap or tongue 2173 that snaps or fits with the tail 2176. It will be appreciated by one skilled in the art that the body can be configured with a female snap or receiving port in which a portion of the tail 2156 can be secure.

Figure 8:
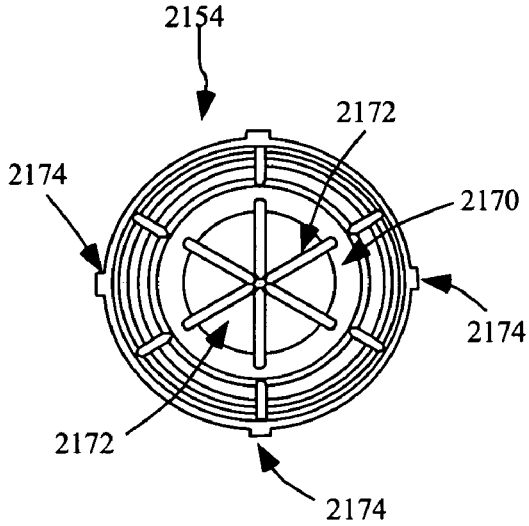
FIG. 8 shows an elevated view of the body of FIG. 7 looking into the hollow portion along an axis shown in FIG. 7.

FIG. 8 shows an elevated view of the body 2154 looking into the hollow portion 2170 along an axis 2171 shown in FIG. 7. The body can include structural fracture points 2172 to aid in the rupture of the body 2154. Alternatively, the body can include support structures to add rigidity to the body for embodiments where the body is not to break or rupture.

Figure 9:
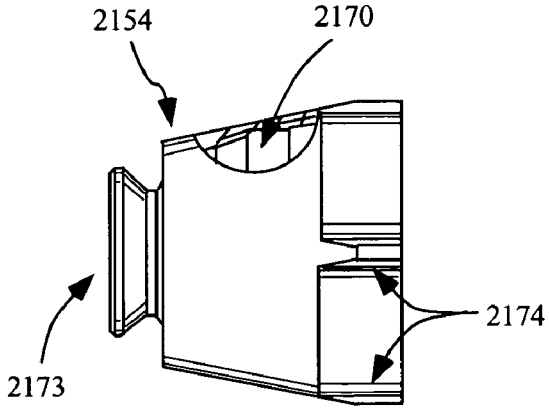
FIG. 9 depicts a side view of the body of FIGS. 7-8 with a cutaway portion shown.

FIG. 9 shows a side view of the body 2154 with a cutaway portion. The cutaway portion shows the hollow portion 2170. The body can additionally include stabilizers 2174 formed along the exterior of the body. The stabilizers provide additional stability during flight of the projectile.

Figure 10:
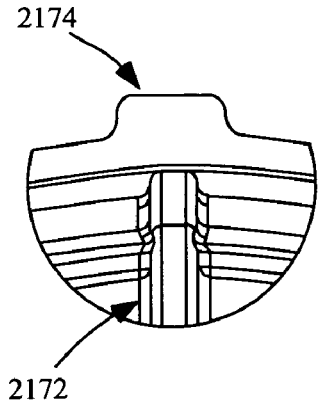
FIG. 10 is an enlarged view of the rim of the mouth of the body shown in FIGS. 7-9.

FIG. 10 is an enlarged view of the rim of the mouth of the body 2154 as indicated by the circled area in FIG. 8. The enlarged area shows a stabilizer 2174. Additionally, a fracture point 2172 is shown in greater detail.

Figure 11:
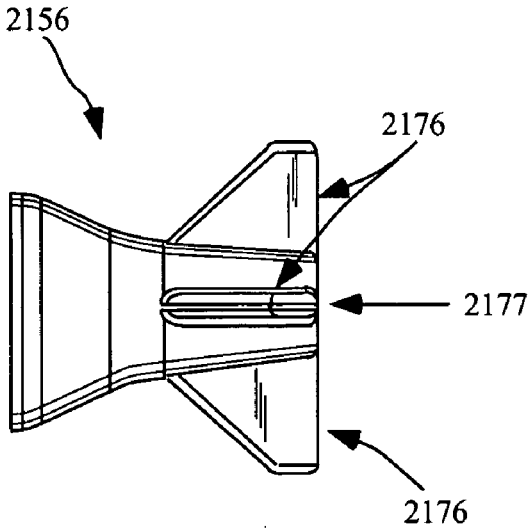
FIG. 11 shows a side view of the tail of FIG. 4.

FIG. 11 shows a side view of the tail 2156. The tail includes a plurality of fins 2176. The tail can be made of substantially any material capable of withstanding launch loads without structurally failing. For example, tail 2156 can be made of material similar to that of the nose and/or the body, such as acrylic, vinyl, plastic, polystyrene and/or other polymers, sodium alginate, calcium chloride, coated alginate and/or polyvinyl alginate (PVA). Alternatively, the tail can be made of a rubber, urethane or other flexible material.

The fins 2176 may be made of the same material as the tail 2156 or other flexible material, such as rubber, urethane, polyethylene and other similar materials to withstand the launch loads without structurally failing. Typically, the tail and fins are formed as a single, continuous piece. However, the fins 2716 can be individual fins or may be a single fin body including more than one fin, for example, four fins, that are attached or bonded to the projectile tail 2156.

Figure 12:
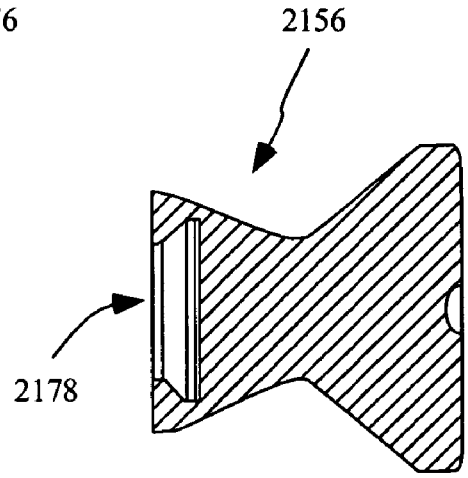
FIG. 12 shows a cross-sectional view of the tail of FIG. 11.

FIG. 12 shows a cross-sectional view of the tail 2156. The tail includes female receiving port 2178 for coupling with the body. In this embodiment, the body and tail are snapped and sealed together. Additionally and/or alternatively, the tail can be ultrasonically welded, glued, bonded, and other methods for securing. As discussed above, in some embodiments, the tail and body are a single continuous piece.

In some embodiments, the fins extend up along the body providing greater fin length than the tail. In some of these embodiments, the fins can additionally be secured with the body. Alternatively, the fins can have a length equal to or less than a length of the tail 2156. FIG. 12 shows an embodiment with the fins having a length shorter than the length of the tail 2156.

Figure 13:
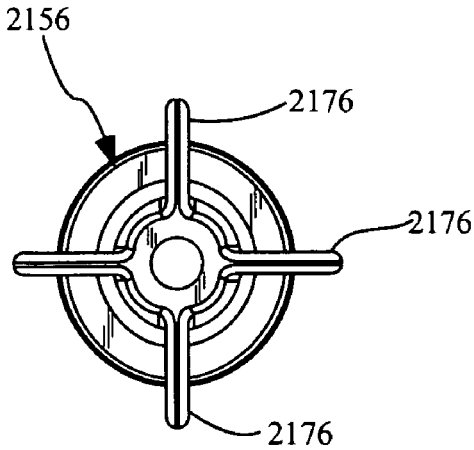
FIG. 13 shows a rear view of the tail of FIGS. 11-12.

FIG. 13 shows a rear view of the tail 2156 along the line 2177 indicated in FIG. 11. The tail 2156 is shown with four fins 2176. However, any number of fins can be included to provide stability to the projectile during flight.

The use of multiple parts to construct the projectile can be utilized in any of the projectiles depicted and/or described herein. In some embodiments, a nose can be configured to fit a plurality of different body configurations. Similarly, a tale can be configured to fit a plurality of different body shapes. Additionally, a body can be constructed to fit any number of nose and/or tail configurations.

The projectile 2110 with loaded substance 2111 is designed to have an optimal center of gravity. The optimal center of gravity provides for a more accurate flight path and further enhances the rupture of the frangible nose 2113 and thus enhancing the distribution of the substance. For example, the center of gravity can be directly at a center of the length of the projectile when the projectiles are constructed such that the tail counter balances the nose. Alternatively, the center of gravity can be positioned slightly toward the nose to better ensure that the projectile contacts the target nose first.

The nose 2113 and/or body 2112 are preferably formed, by injection molding or by being hot pressed; however other methods are also suitable. For example, the hemispherical nose 2113 can be formed using a carefully temperature controlled draw of polystyrene, similar to the formation of spherical capsules described in U.S. Pat. No. 5,254,379, incorporated herein by reference, (hereinafter the '379 patent).

Production of the capsule of the '379 patent in this fashion can, however, be time consuming and, where being manufactured for the purpose of delivering paint to a target, requires careful attention to feed rates and maintenance of temperature differences between injection feeds of the paint and forming of the capsules. In contrast, and as discussed further herein, the preferred projectiles of the present invention may be quickly formed, filled and sealed at very high production rates, in part, because the nose 2113 and body 2112 are typically formed separately. In some embodiments, the nose and body are then appropriately filled, joined and sealed. Alternatively, in some preferred embodiments, the nose and body are joined and sealed. Then the substance 2111 is delivered to the cavity 2114 through a fill opening 614 (see FIG. 23).

The body 2112 of the projectile 2110 can be configured to be more structurally stable than the nose 2113. As such, in some embodiments, the body can be reused. Once a projectile 2110 is launched or fired, the nose ruptures upon impact dispersing the substance 2111. The body can then be retrieved, a new nose affixed, re-filled with a desired substances and again launched.

Figure 14:
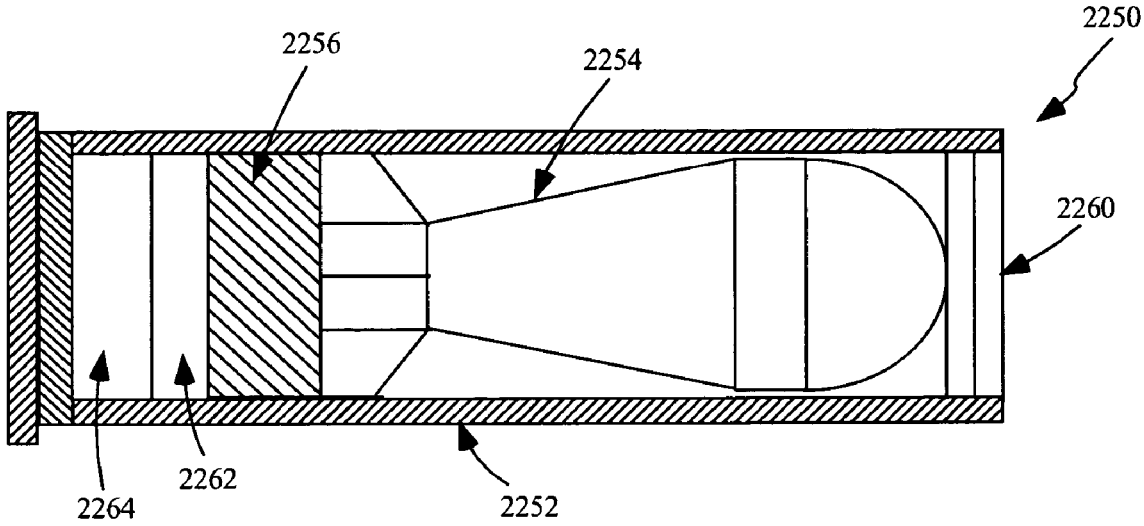
FIG. 14 is side cross-sectional view of alternative projectile systems for delivering a substance to a target.
Figure 15:
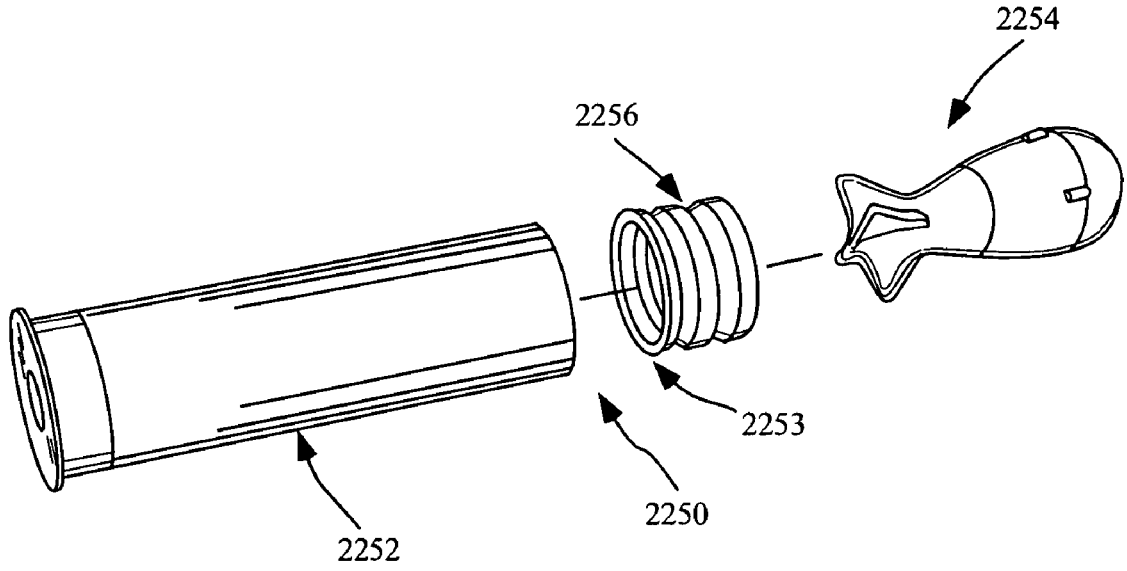
FIG. 15 is an elevated side view of the projection system of FIG. 14.

FIG. 14 is side cross-sectional view of alternative projectile systems 2250 for delivering a substance, such as an inhibiting substance, to a target in accordance with additional embodiments of the present invention, wherein a twelve-gauge shotgun shell 2252 is packed with a projectile 2254. FIG. 15 is an elevated side view of the projection system 2250. The projectile 2254 can be similar to the projectile described above and shown FIGS. 1-4 that contain the substance to be delivered to the target, such as oleoresin capsicum. Advantageously, the modified shotgun shell 2252 in accordance with the embodiments illustrated in FIGS. 14 and 15 may be used with standard, commercially available shotguns.

Shown in FIG. 14 are the twelve-gauge shotgun shell 2252, the projectile 2254, a propulsion block or lid 2256, a seal 2260 (typically air tight), wadding 2262, and black powder, gun powder or other ignitable or explosive substances or powders 2264. In some embodiments the shell includes a primer that aids in igniting the gun powder. In some embodiments, the powder 2264 is only a primer material or powder. These embodiments can in some instances provide more consistent projectile velocities than can be achieved with gun powder. In some embodiments the powder 2264 is a mixture of primer and gun powder. Some of these embodiments can be configured with a larger amount of primer than gun powder, to again provide a more consistent projectile velocity. The reduced gun powder or elimination of gun power can provide a reduced muzzle blast and reduce heat generation.

Shown in FIG. 15 are the shotgun shell 2252, the propulsion block 2256 and the projectile 2254 as would result just after firing or activating the shotgun shell to propel the projectile 2254. The shell 2252 can be a standard shot gun shell or can be a shell with an increased thickness. Additionally and/or alternatively, a liner, such as a plastic liner can be added to the shell to add rigidity, allow increased pressures, be reusable, and other similar functions. For example, a liner of less than 0.5 inches, such as 0.3 inches could be added to the shell 2252. The liner 2266 can be plastic, ceramic, metal and other similar materials. Further, the liner can run the length of the interior of the shell, or just a portion of the length of the shell. Upon firing of the shotgun shell 2252, the black powder, primer or other ignitable substance 2264 is ignited, which causes the expansion of gases forcing the wadding 2262 (if present) and propulsion block 2256 to drive the projectile 2254 out of the shotgun shell 2252. Such forcing out of the wadding 2262, propulsion block 2256 and the projectile 2254 breaks the seal 2260. The propulsion block 2256, may impact the target or may fall short of the target. Some of the primary purposes of the propulsion block 2256 are to maximize the absorbed thrust from the gun powder, primer and/or other ignitable substance 2264 that is transferred to the projectile, and to distribute the force providing an even distribution of force to the projectile.

The size of the propulsion block 2256 is designed to harness a majority of the propulsion force provided by the ignited substance 2264. As such, in some embodiments, the diameter of at least a portion of the propulsion block 2256 is typically at least equal to or larger than the diameter of the shell 2252. The diameter of the propulsion block 2256 is typically designed to create a seal between the propulsion block and the inner diameter of the shell 2252. Further, some embodiments of the propulsion block are designed to have an extended seal region where the seal created between the propulsion block and the shell has an increased length further ensuring a seal and a maximum transfer of propulsion energy to the projectile 2254. Additionally and/or alternatively, the seal between the projection block and the shell can include a plurality of seals spaced across a length of the projection block 2256. In some embodiments, a small amount of lubricant and or sealant, such as oil, graphite or other lubricant can be included at the seal between the propulsion block and the shell to improve the seal and/or reduce friction and allow for an increased velocity.

The propulsion block 2256 can be of substantially any relevant shape and/or configuration that established the desired seal effect within the shell 2252. In some embodiments the propulsion block is partially hollow, such as hollow cylinder or a cup shape to reduce the weight of the propulsion block and limit the distance of travel of the propulsion block. The hollow portion is typically closed at one end by a plate or cap. The plate, in some embodiments, extends out beyond the cylinder portion to form a portion of the desired seal with the shell. The propulsion block 2256 can include one or more lips 2253 that protrude away from a central axis of the propulsion block and extend around the perimeter of the propulsion block, typically near or at one end of the propulsion block (such as at the opposite end from the plate). The protruding lip 2253 can define a larger diameter for the propulsion block that is greater than the diameter of the shell. Further, in some preferred embodiments, the lip is flexible and tends flex to establish greater contact with the interior of the shell producing an enhanced seal. The lip 2253 can further be perpendicular to the central axis or taper from the central axis at an angle.

Reinforcement structures can also be included in some embodiments of the propulsion block 2256. For example, the hollow, cylinder shaped embodiment can include the plate to close the end. The plate can further includes radially extending reinforcement structures that add rigidity and stability to the propulsion block. Some embodiments further include additional ribbing and/or one or more structural rings positioned along the length of the block. The ring(s) extends around the perimeter of the interior or exterior of the propulsion block. This ribbing and/or ring can add further structural support. The ring can additionally enhance and/or provide an additional seal between the ring and the shell, when the ring is formed on the exterior of the block.

In some embodiments, the propulsion block can be eliminated and the projectile 2254 is configured with a diameter that is substantially equal to or just greater than the inner diameter of the shell 2252. The diameter of the propulsion block is typically of a sufficient size to chock off the flow between the high pressure, flame front and the low pressure, atmosphere side. As such, the projectile produces a seal between the projectile and the shell such that the propulsion force produced by the ignited substance 2264 is directly applied to the projectile. Similar to some embodiments of the propulsion block, the projectile 2254, in some embodiments, can be configured such that the seal between the projectile and the shell 2252 is a long seal and has a length that extended along a portion of the length of the projectile to establish the seal. The seal between the propulsion block and/or the projecting can equally be employed with other types of propulsion, for example, compressed gas and other similar propulsion techniques.

The propulsion block can be constructed of substantially any material capable of withstanding the pressure and temperatures exerted on the block from the ignition of the ignitable substance 2264 (or compressed air applied to the block as described below). For example, the propulsion block can be constructed of plastic, metal or metals, ceramics, other similar materials and/or combinations thereof. Similarly, the projectile can be constructed at least in part of similar materials when the propulsion block is not used, or simply to provide added strength to the projectile or provide an additional seal within the shell.

Figure 16:
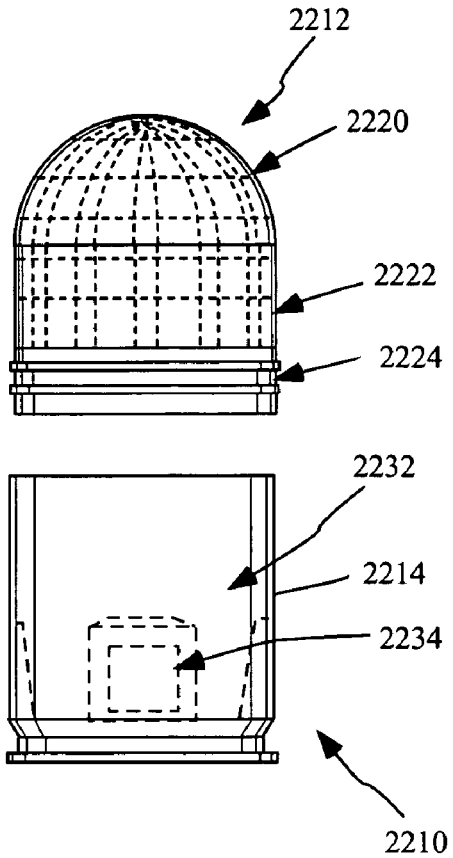
FIG. 16 shows a partially transparent, side view of a projectile system for delivering a substance to a target.
Figure 17:
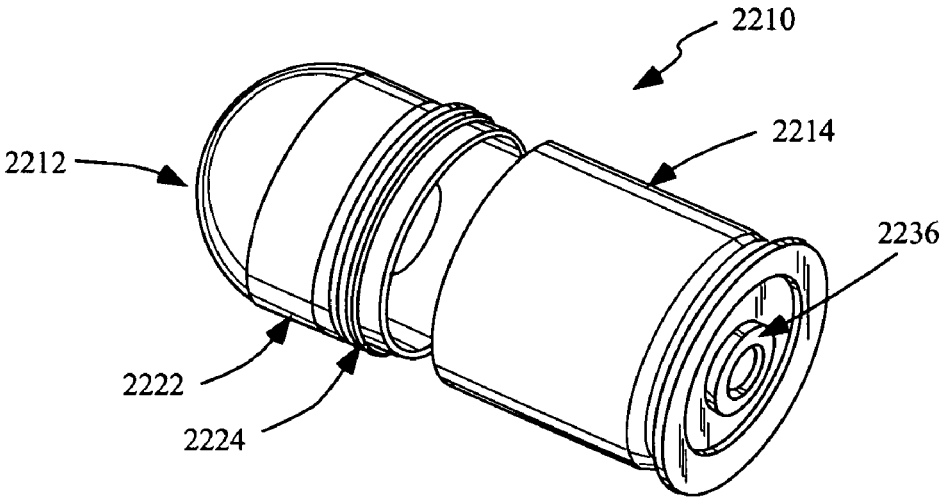
FIG. 17 shows an elevated view of the projectile system of FIG. 16.

Referring to FIGS. 16 and 17, wherein FIG. 16 shows a partially transparent, side view of a projectile system 2210 for delivering a substance, for example, an inhibiting or inert liquid or powder substance to a target in accordance with one embodiment of the present invention. FIG. 17 shows an elevated view of the projectile system 2210. The projectile system 2210 includes a projectile 2212 and a projection cartridge 2214, where the projection cartridge 2214 is configured to propel the projectile 2212 towards the target.

The projectile 2212 includes a nose 2220, a body 2222 and a projectile seal 2224. In some embodiments, the body includes stabilizing fins, which can be similar to those described above with reference to FIGS. 1-4 and 11-15, as well as those fins described below with reference to at least FIGS. 26-29. The nose is typically formed of a frangible section that is configured to rupture or break upon impact with the target. The nose 2220 and body 2222 can be formed as a single continuous piece or separate pieces. In some embodiments, the body is also frangible and can additionally break when the projectile 2212 strikes a target dispersing a substance contained within the projectile. The projectile seal 2224 is secured with the projectile body 2222, and cooperates with the cartridge securing the projectile with the cartridge until sufficient force is applied to propel the projectile away from the cartridge.

Figure 18:
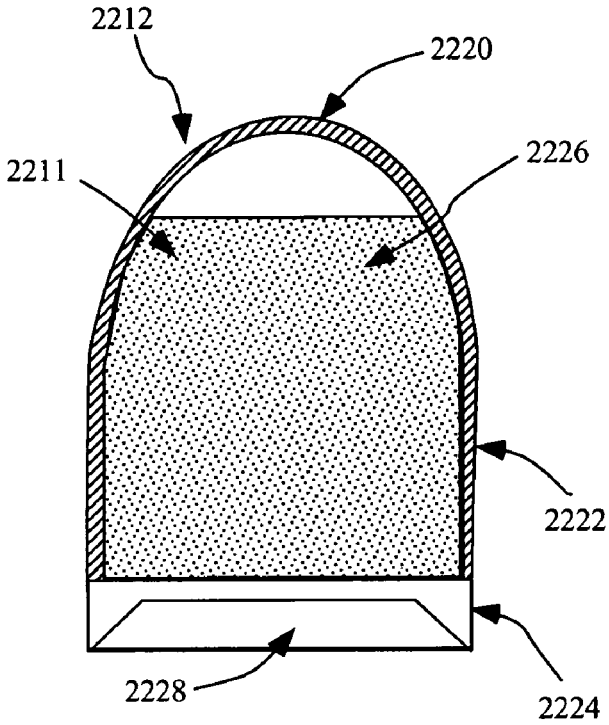
FIG. 18 shows a cross-section view of the projectile system of FIGS. 16 and 17.

FIG. 18 shows a cross-section view of the projectile 2212. The nose 2220 and projectile body 2222 have hollow portions forming a cavity 2226. The cavity can be filled with an inhibiting and/or inert substance 2211 to be delivered to the target. The cavity 2226 can be configured to substantially any size to deliver a desired amount of substance at the target. The weight, the size, the amount of force provided by the cartridge 2214 and the size of a device to activate the projectile system 2210 (if needed) are further factors which limit the size. In some embodiments, the projectile system 2210 is similar in size to a bullet, such as a 38 caliber, 45 caliber or other caliber bullet. This allows the projectile system 2210 to be utilized with a standard, commercially available fire arm or gun. Alternatively, the projection system 2210 can have a size similar to a flare, where a commercially available flare gun or other similar device can be utilized to activate the projectile system to launch the projectile 2212. In some embodiments, the projectile system 2210 has a size similar to that of a shotgun shell, such as a twelve-gauge shotgun shell. This allows the projectile system 2210 to be utilized in a standard, commercially available shotgun.

The seal secures the projectile 2212 with the cartridge 2214. Typically, the seal fits into a cavity 2232 of the cartridge. In some embodiments, the seal 2224 includes a recess 2228 that is formed in the seal opposite to the projectile body and nose. This recess 2228 focuses a propulsion force towards a central axis of the projectile 2212.

The cartridge 2214 provides propulsion to the projectile 2212. The cartridge typically includes a propellant, such as compressed gas, gun powder, other flammable and/or explosive substances, and other propellants. In one embodiment, the cartridge includes a cavity 2232 in which at least a portion of the projectile seal 2224 is secured. The cavity can also be configured to hold the propellant or is configured to allow the propellant to disperse so than a distributed force is applied on the projectile 2212.

Referring back to FIG. 16, the cartridge 2214 is shown to include a gas casing 2234 that contains compressed gas. The cartridge further includes an initiator 2236 (see FIG. 17). The initiator activates the propellant to discharge and force the projectile 2212 away from the cartridge and towards the target. In some embodiments, the activator is similar to those found in bullets or shotgun shells. The activator triggers the gun powder or just a primer to ignite creating a force to drive the projectile 2212. Alternatively, the activator 2236 can open a seal of a casing 2234 releasing compressed gas or gases.

The cartridge can be formed of metal, plastic, PVC and other similar materials or combination of materials. The cartridge can be constructed to be reusable.

It has been discovered, by the present inventors, that the effectiveness of projectile systems employing projectiles to deliver powdered non-lethal substances, such as powdered oleoresin capsicum, to a target are maximized by filling the projectile volume to at least about 30%, preferably 40% to less than 100%, more preferably 85% to 95% of their maximum volume, and most preferably to about 90% of their maximum volume. The present inventors' discovery of an optimal fill range represents a significant improvement, one that enables the use of powdered inhibiting substances in a commercially viable non-lethal or less-than-lethal projectile. This optimal fill range further represents an unexpected result. The fill range is further described in U.S. Pat. No. 5,965,839, filed Nov. 18, 1996, entitled "NON-LETHAL PROJECTILE FOR DELIVERING AN INHIBITING SUBSTANCE TO A LIVING TARGET", and U.S. Pat. No. 6,393,992, filed Apr. 9, 1999, entitled "NON-LETHAL PROJECTILE FOR DELIVERING AN INHIBITING SUBSTANCE TO A LIVING TARGET", and co-pending U.S. patent application Ser. No. 10/146,013, filed May 14, 2002, entitled "SYSTEM AND METHOD FOR STORING AND LAUNCHING NON-LETHAL PROJECTILES" each of which are incorporated herein in their entirety.

However, at the same time, this optimal fill range poses a different problem, which is addressed herein below, that is, how to fill each of the nose 2113, 2212 and body 2112, 2222 so that a resultant projectile has the optimal fill range, without significant spillage of the substance contained therein during closure of the nose and body.

In alternative embodiments, the cartridge 2214 is replaced with a caseless propellant. The caseless propellant is ignited and generates the propulsion force similar to that of gun powder, a primer, a primer and gun powder mix and other similar ignitable substances. The caseless propellant is formed such that the cartridge portion 2214 is rigid and stable until ignited, for example with an electric charge or a primer. Once ignited, the caseless propellant is almost completely consumed or completely consumed as it generates the propulsion force that is exerted on the projectile 2212.

Figure 19:
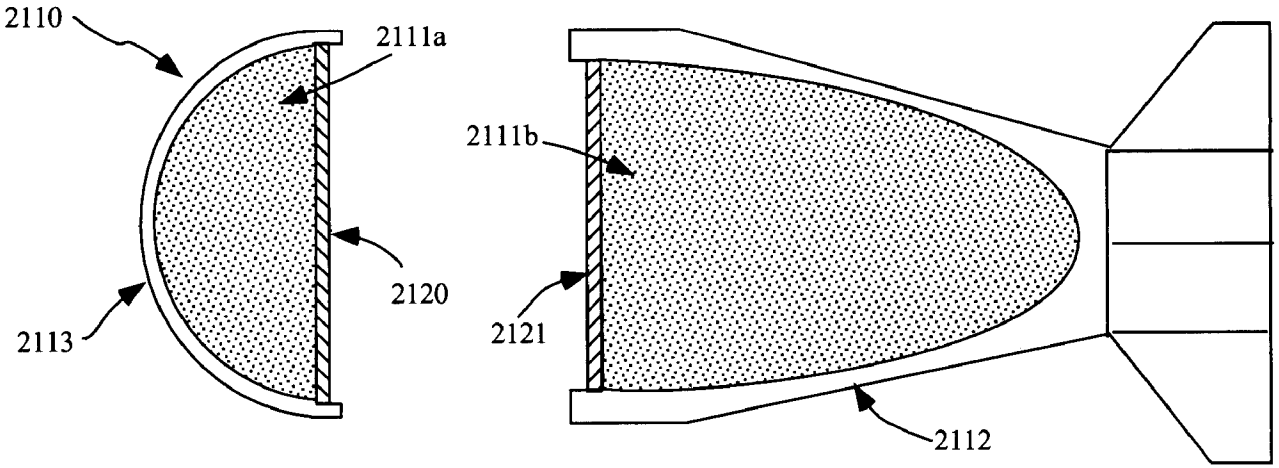
FIG. 19 shows a cross sectional view of a projectile, similar to that shown in FIGS. 1-4, prior to assembly.
Figure 20:
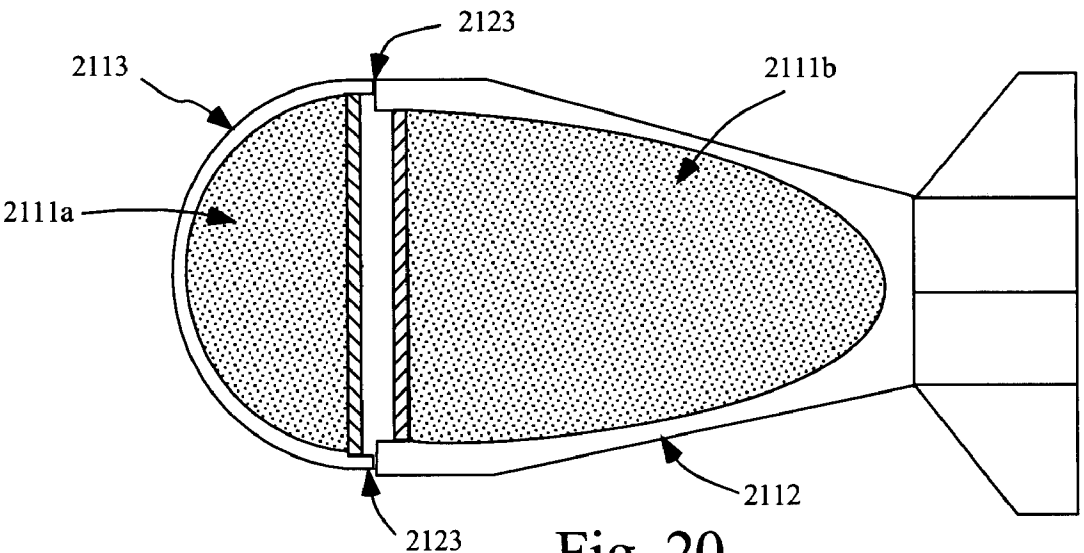
FIG. 20 shows the projectile of FIG. 19 after the nose and body are joined to one another.

Referring to FIGS. 19-25, illustrated are the stages of two preferred assembly methods of a projectile system 2110, in accordance herewith, comprising a hemispherical nose 2113 and a body 2112 forming a cavity 2114 containing a substance 2111*a*, 2111*b*, such as a powdered substance. FIG. 19 shows a cross sectional view of a projectile 2010 prior to assembly according to one embodiment of the present invention, with the nose 2113 detached from the body 2112. As illustrated in FIGS. 19-20, the problem of spillage during assembly is overcome in this embodiment by employing a thin membrane 2120, 2121 within one or both of the nose 2113 and/or body 2112 after each is filled to a desired level with a powdered substance 2111*a*, 2111*b* (the two portion of substance 2111*a*, 2111*b* together constituting the optimal fill of the projectile 2110). The membranes 2120, 2121 retain respective portions of the substance 2111*a*, 2111*b* within each of the nose and body, respectively, to facilitate assembly of the projectile 2110 without spilling the substance 2111*a*, 2111*b* during assembly.

FIG. 20 shows the projectile 2110 after the nose 2113 and body 2112 are joined to one another. Upon joining of the nose and body, the projectile 2110 is then, optionally, sealed along the point of joining 2123 by, for example, ultrasound welding, with the use of a glue or solvent, or other methods for sealing. In preferred embodiments, the projectile is hermetically sealed along the joining seam 2023, such that moisture and/or other contaminants cannot enter the cavity, spoiling its contents.

In a still further preferred aspect, the sealed cavity of the projectile system 2110 is shaken or otherwise subjected to sufficient force to cause rupture of the membranes 2120, 2121 within the projectile 2110, such that the substance 2111 within the projectile becomes mixed and moves relatively freely within the projectile. It is noted that the glue/solvent is not illustrated in FIG. 20 because they are cut away views of the projectile system 2110. Also, not illustrated are the remnants of the membranes 2120, 2121 in, for example, FIG. 3 following rupture of the membranes 2120, 2121, as just described.

Membranes can be utilized to aid in filling any of the projectiles depicted and/or described herein.

Figure 21:
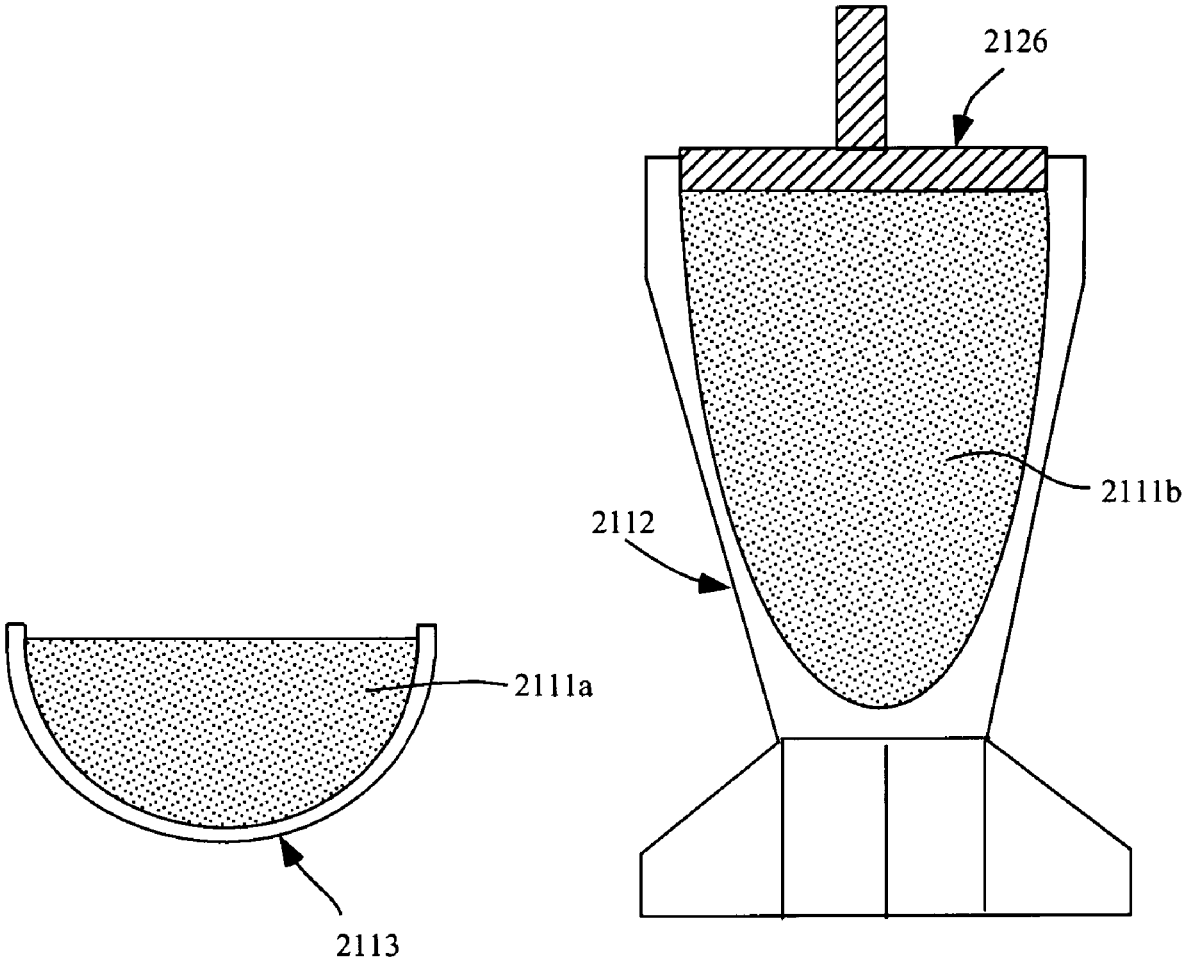
FIG. 21 depicts a cross sectional view of a projectile, similar to that shown in FIGS. 1-3, showing an alterative method for assembling the projectile.

In an alternative preferred assembly method, illustrated in FIG. 21, a mandrel 2126 or other similar tool, may be employed to mechanically compress or tamp the powdered substance 2111*a*, 2111*b* within each of the nose 2113 and body 2112 to retain the substance therein during the remainder of the assembly process. In FIG. 21, the nose 2113 is shown as having had its contents 2111*a* compressed, while the body 2112 is shown with the mandrel 2126 therein. It will be appreciated by those of skill in the art that the mandrel or other similar tool may be, and preferably is, a part of a machine (not illustrated) used to mechanically assemble the projectile in accordance herewith. The compressing of the substance to facilitate assembly of the projectile can be utilized in any of the projectiles depicted and/or described herein.

Figure 22:
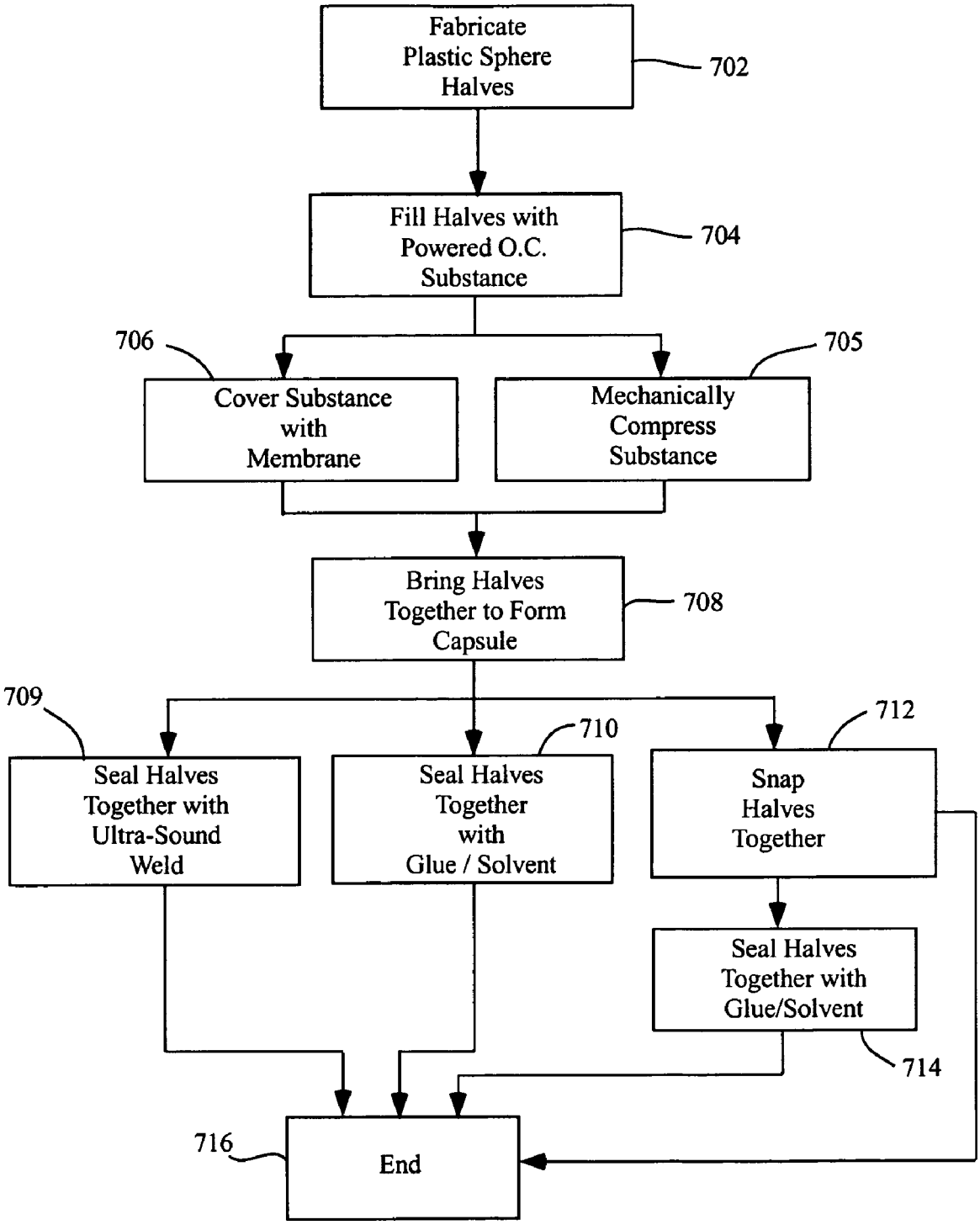
FIG. 22 depicts a flow chart detailing a method of assembly of a projectile system, including steps directed towards FIGS. 19-21.

Referring now to FIG. 22, a flow chart is shown illustrating in detail preferred methods of assembly of a projectile system 2110, in accordance herewith, wherein the projectile system 2110 is formed from a nose 2113 and body 2112, the structures of which are described above, which projectile 2110 contains a substance, such as a powder substance, especially a powdered inhibiting substance, and most preferably a powdered capsaicinoid or oleoresin capsicum composition. The method illustrated includes some of the preferred alternatives for assembly.

Thus, in a preferred method, the nose 2113 and body 2112 are fabricated using suitable molding or forming techniques (Block 702), and each is filled (Block 704) to about 90% of its volume with the substance 2111, to be delivered to the target, especially a powdered substance, and most preferably an inhibiting powdered substance. In one alternative, a thin membrane 2120, 2121 (see FIGS. 19 and 20) is then placed (Block 706) into each of the nose 2113 and body 2112 to cover the substance 2111 contained therein. In some embodiments, the substance is compressed prior to or during the insertion of the membrane. In addition to or in a second alternative a mandrel 2126, or other tool, is used to mechanically compress the substance within the nose and body (Block 705). At this point in the method, nose and body are substantially as shown in FIGS. 19 and/or 21, with and without membranes, respectively.

In practice, one or both of the nose and body, after having been mechanically compressed and/or covered by the membranes, are then preferably rotated to align with the other or with one another, and brought together (Block 708). For example, the nose can be filled, the substance compressed and covered by a membrane, the body filled and the substance compressed, then the nose rotated to align with the body, and then brought down onto the body.

The nose and body are then preferably sealed to one another (Blocks 709, 710, 712, 714), such as using ultrasonic welding techniques (Block 709), or using an appropriate solvent or glue (Block 710) or by snapping the nose and body together (Block 712), or other similar techniques or combinations of these and other techniques. For example, if polystyrene is used to construct part or all of the nose and/or body, many known solvents are available that will dissolve the polystyrene just enough to result in sealing of the same as the plastic hardens upon evaporation of the solvent. Polystyrene is commonly used for plastic models, and thus, various modeling glues are available that provide suitable sealing. With respect to the alternative of sealing, the snapping together, such as using interlocking flanges, is described and depicted in detail in U.S. Pat. Nos. 5,965,839 and 6,393,992, and U.S. patent application Ser. No. 10/146,013, each previously incorporated earlier in their entirety.

The method of assembly can be utilized in any of the projectiles depicted and/or described herein.

In embodiments employing membranes, the membranes 2120, 2121 (see FIGS. 19 and 20) are selected to be strong enough to retain the substance 2111*a*, 2111*b* within the nose 2113 and body 2112, respectively, as the two are joined, yet thin enough to readily rupture on or before impact of the projectile system 2110 with the target. Most preferable, in this regard, are thin, circular cut, paper membranes that will tension against respective inner walls of the nose and/or body sufficiently to retain the substances 2111*a*, 2111*b* therein. For example, the membrane may tension within an interior scoring of the nose and/or body where such is provided. It will be appreciated by those of skill in the art that the membranes useful in these embodiments may be formed of any number of materials, including for example, paper, plastic or other polymer, rubber, cork foam sponge and the like. Generally, the membranes will be cut to have a shape similar to the shape of the hollowed portions of the nose and/or body, for example circular. The membranes are typically slightly larger than the interior circumference or perimeter of the nose and body at the point where the membrane is to contact that interior surface. Thus, when placed into the nose and body and, preferably, compressed, the membrane will tension against the interior surface of the nose and/or body and thereby retain the substance therein. For example, the membranes are preferably from between about 1 to about 5 mm thick, most preferably about 3 mm; however, other thickness are likewise contemplated herein, especially depending upon the specific substance contained within the projectile. For example, where both a liquid and a powdered substance are to be included in the projectile, it may be advantageous to provide a slightly thicker membrane to insure separation of the two substances until rupture of the projectile on or about the target.

Various preferred embodiments of the projectile systems 2110, 2210 are constructed wherein the nose 2113, 2220 and/or body 2112, 2222 include structurally weakening features or fracture points on the exterior and/or interior surfaces thereof, which fracture points primarily facilitate rupture of the nose 2113, 2220 and/or body 2110, 2222 upon impact with a target. These fracture points can be implemented similar to weakening features or fracture points described and depicted in U.S. Pat. Nos. 5,965,839 and 6,393,992, and U.S. patent application Ser. No. 10/146,013, each previously incorporated by reference above.

The fracture points can be one or more dimples, a pattern of exterior and/or interior dimples, scoring, a matrix pattern of exterior and/or interior scoring, and other such fracture points. These fracture points serve the tripartite purposes of facilitating rupture of at least part of the projectile, atomization of the substance (e.g., inhibiting substance) upon impact with the living target, and of decreasing drag and increasing lift during flight of the projectile system.

Figure 23:
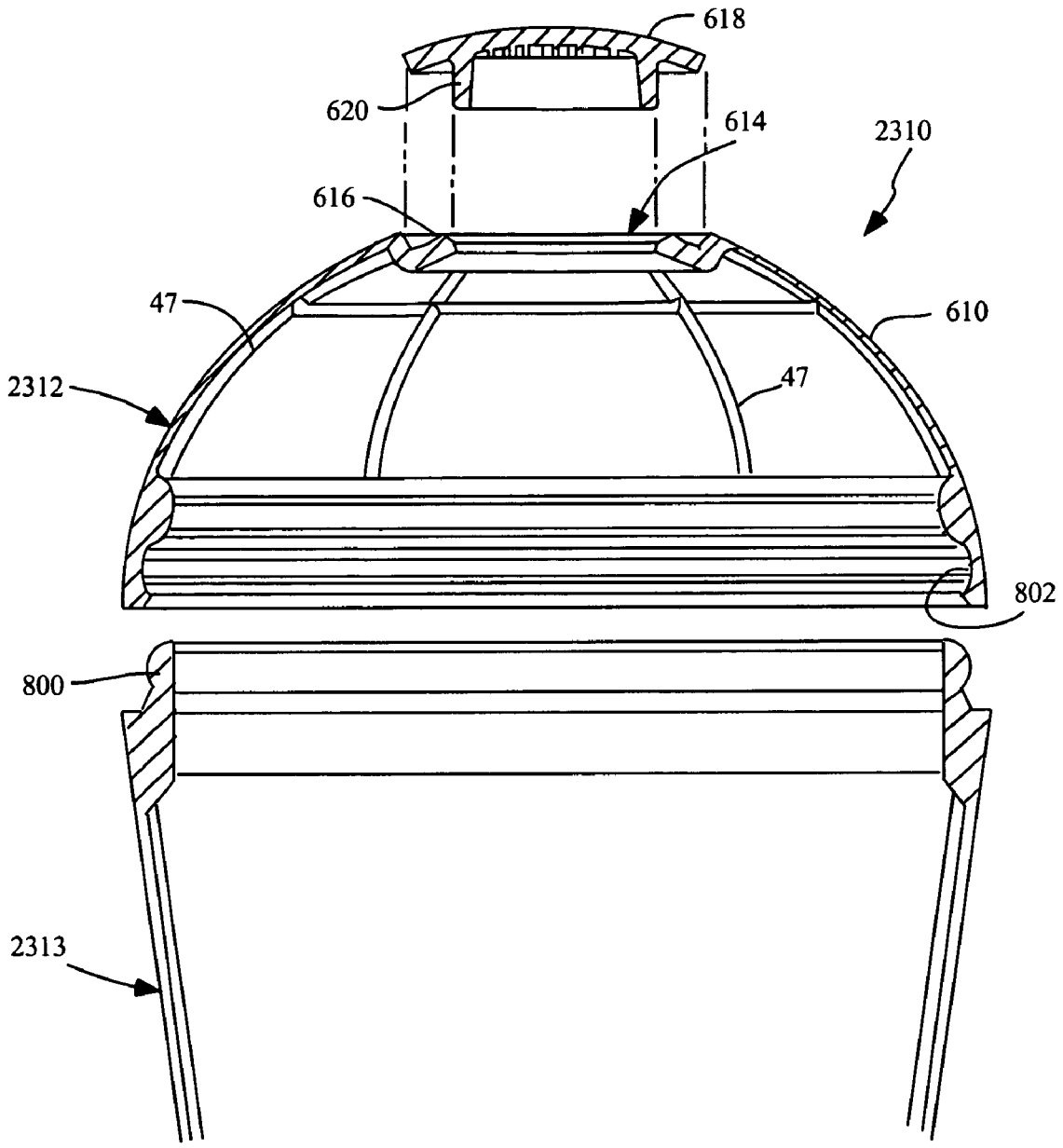
FIG. 23 shows components of a three-part projectile or projectile system as a variation of the projectiles of FIG. 1, FIG. 4 and/or FIG. 16.

Referring next to FIG. 23, an illustration is shown of the components of a three-part projectile or projectile system 2310 as a variation of the projectiles of FIG. 1, FIG. 4 and/or FIG. 16 in accordance with another embodiment of the present invention. Furthermore, while referring to FIG. 23, concurrent reference is made to FIG. 25, which is a flowchart showing a process 1400 for one embodiment of the steps performed in assembling and filling the three-part projectile of FIG. 23.

Shown in FIG. 23 is a cross-sectional view of a nose 2313, a lid 618 and a portion of the body 2312 of a three-part projectile 2310. The lid 618 may also be referred to as a third part 618. The body 2312 and the nose 2313 are similar to the noses and bodies described above. As an initial step in the assembly of the three-part projectile, the parts of the three-part projectile are fabricated (Step 1402 of FIG. 25), using similar techniques as described with reference to FIG. 22. The body 2312 can include a flange 800 that is designed to mate with a flange 802 of the nose 2313. These flanges 800 and 802 may snap together, glued together, or otherwise be bonded together, e.g. ultrasonic bonding, similar to the techniques described with reference to FIG. 22 and in the formation of hermetic seals.

Furthermore, the nose 2313 includes a fill hole 614 formed at a pole of the hemispherical nose. The fill hole includes a flange 616 at its perimeter that is designed to receive the lid or third part 618. The lid 618 includes a rim 620 that is adapted to be inserted into the fill hole 614 against the flange 616 such that the top surface of the lid 618 fits preferably flush with the exterior surface of the nose 2313. Note also, that the nose 2313 has interior surface scorings 47, in a longitudinal and/or latitudinal pattern formed within the nose 2313. In some embodiments, similar scoring can additionally be included within the body 2112. Such interior scorings 47 are not required, but are preferred since they provide a controlled fracturing of the nose and/or projectile which optimizes the dispersal of substances contained therein.

The addition of the fill hole 618 formed in the nose 2113 advantageously allows for a simple and effective operation of filling the projectile 2310 with either liquid or powder substances in a manner wherein a majority of the volume contained within the projectile is filled with the substances. For example, using the three-part projectile, the cavity may be filled with at least 90% of its interior volume with either a liquid or a powder substance.

The three-part projectile is manufactured by adhering and sealing the body 2312 to the nose 2313 (Step 1404 of FIG. 25) similarly as described above with reference to FIG. 22, for example, by snapping, gluing, ultrasonic welding and/or otherwise bonding the body to the nose and includes forming hermetic seals as well. Then, the substance or substances to be delivered within the projectile are inserted into the volume of the combination of the body and the nose through the fill hole 614 in the nose 2313 (Step 1406 of FIG. 25).

The fill hole 614 is large enough such that the substance, whether liquid or powder, may be poured into the projectile without spilling, at least when properly filled. Advantageously, the fill hole is large enough such that spillage rarely occurs with the proper techniques, for example, using a pipe, funnel, automatically or manually driven auger system, or similar pouring and/or guiding device. As an optional step, particularly for use with a powdered substance, the powdered substance is compressed (Step 1408 of FIG. 25), for example, with a mandrel or similar object that can be placed within the fill hole 614 to mechanically compress the powder within the volume of body and nose. Then, typically, the volume is refilled (Step 1410 of FIG. 25), which fills the remainder of the volume with the substance, or at least fills the volume to a desired level. Thus, the projectile may literally be filled until almost the entire interior volume of the projectile is taken up by the substance or substances, e.g. at least 80%, or at least 90% or even at least 98%. Advantageously, a higher fill allows the projectile to fly farther and in a straighter flight path.

Once the substance is filled into the projectile 2310, the lid 618 is placed or positioned into the fill hole 614 (Step 1412 of FIG. 25) such that the rim 620 extends into the interior volume of the nose 2313 and fits snugly against the flange 616 of the nose. The exterior surface of the lid 618 is then substantially flush with the exterior surface of the nose, typically after gluing, ultrasonic welding or other bonding. To complete the assembly of the three-part projectile system, the lid or third part 618 is fixed and sealed within the fill hole 614 (Step 1414 of FIG. 25), for example, by adhering, snapping the lid into the fill hole, heat bonding, ultrasonically bonding, friction bonding, or other wise bonding the lid within the fill hole 614 such as described above with reference to FIG. 22. In preferred embodiments, a hermetic seal is created between the body 2312 and the nose 2313, as well as between the lid 618 and the fill hole 614. Thus, at completion of the assembly a three-part projectile is created.

It is noted that the use of membranes, such as described above, or other devices to hold a substance or substances within respective halves, is not required. This provides a much simpler assembly. Further advantageously, a single projectile design will support the filling of both liquid substances and powder substances. Thus, a manufacturer does not need to design two types of projectiles, one to be filled with a liquid substance and one to be filled with a powder substance.

Figure 25:
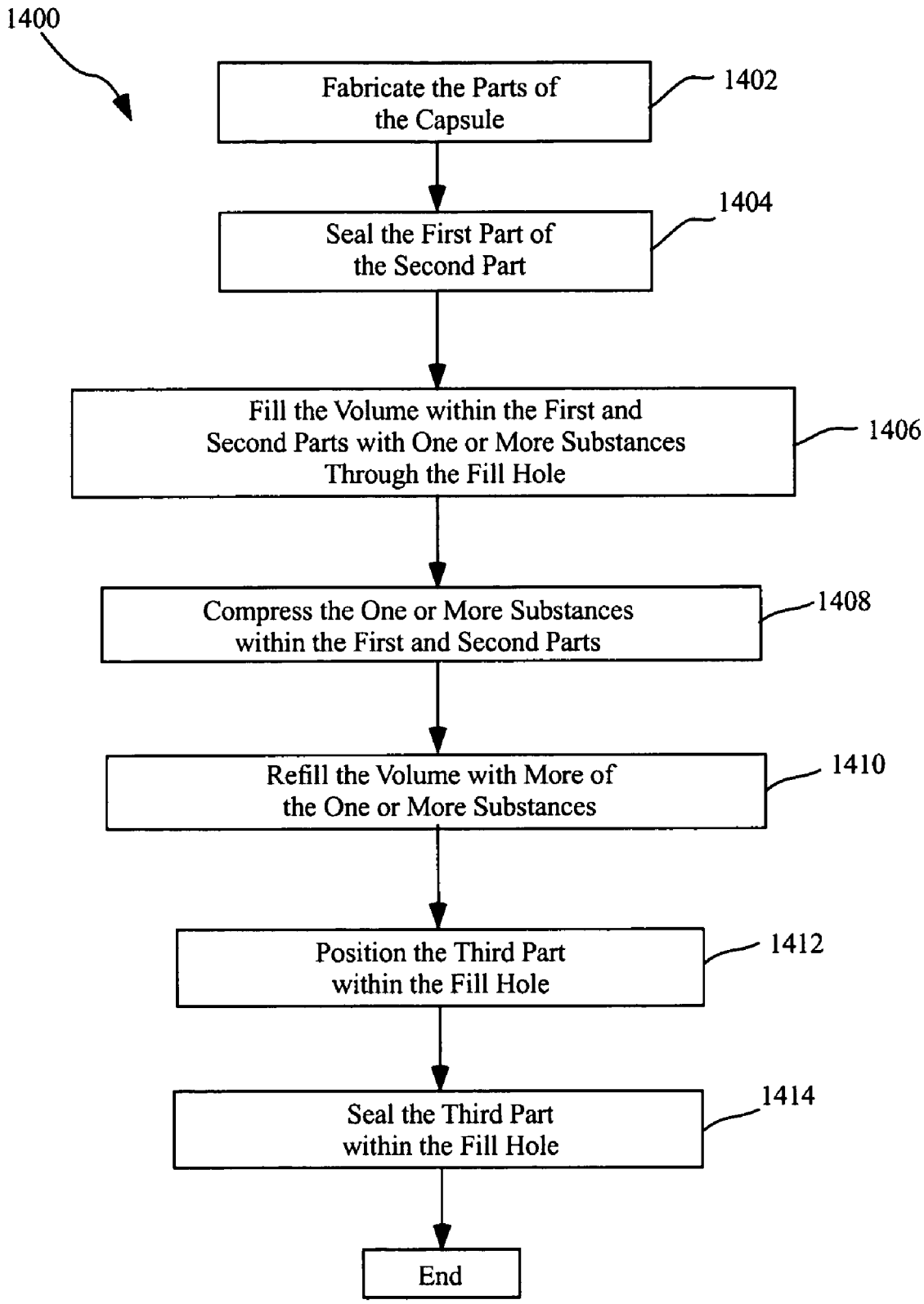
FIG. 25 shows a flowchart of a process for assembling and filling the three-part projectile of FIG. 23.

The method of assembly shown in FIG. 25 can be utilized in substantially any of the projectiles having fill holes depicted and/or described herein.

Figure 24:
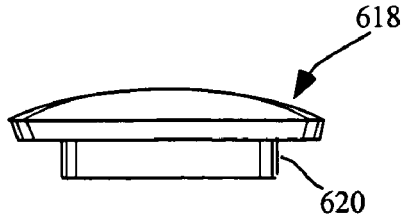
FIG. 24 depicts a perspective view of the lid of the three-part projectile of FIG. 23.

Referring next to FIG. 24, a perspective view is shown of the lid 618 of the three-part projectile of FIG. 23. The lid 618 or third part 618 includes an exterior surface and a rim 620 that is adapted to extend into the volume of the nose. Although the lid 618 may simply be a cutout from the nose, e.g. like a pumpkin lid, the lid is preferably and advantageously formed separately to include the rim 620, which aids in the sealing between the second part 610 and the lid 618.

Referring back to FIG. 23, the nose 2313 is similar in materials, dimensions and manufacture to those previously described, but employs the matrix pattern of interior global scoring 47. The scoring is shown as interior scoring; however, exterior scoring can alternatively or additionally be utilized. The scoring provides a lattice of structural weak points at which the nose casing can burst upon impact with the target.

In one embodiment, the scoring 47 is preferably "V"-shaped in cross-section with an angled or slightly flat bottom portion of the "V" providing a basal portion of such scoring. The scoring preferably has a minimum depth of about 10% to 75%, e.g. 20% to 40% of the thickness of the nose casing or shell 2313 depending on the thickness of the nose shell.

Preferably, there are from between about 1 and 10, e.g., between 2 and 6, circumferential (i.e., latitudinal) scores and from between about 2 and 10, e.g., between 6 and 8 longitudinal scores in the surface of the nose and/or body so as to provide omnidirectional atomization of the inhibiting substance upon impact and a maximal decrease in drag and increase in lift for the projectile.

Figure 26:
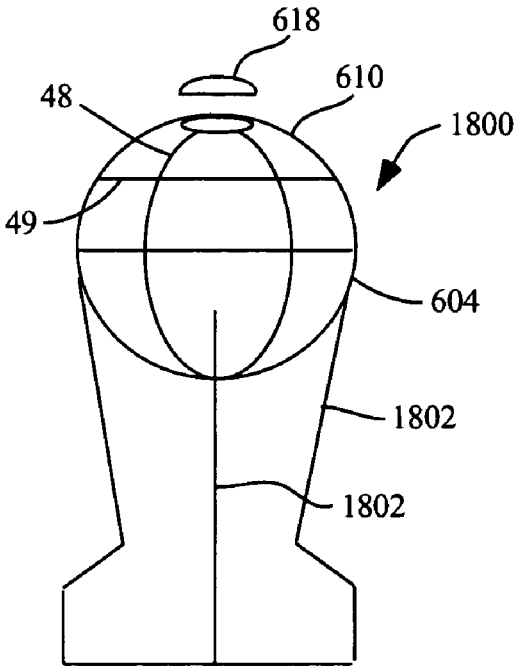
FIG. 26 depicts a side view of a variation of the projectile of FIGS. 1-4, illustrating fins coupled to a portion of the projectile so as to assist in stabilizing the flight of the projectile.

Referring next to FIG. 26, a side view is shown of an embodiment of a variation of the projectile of FIGS. 1-4, illustrating fins 1802 coupled to a portion of the projectile 1800 so as to assist in stabilizing the flight of the projectile. Shown is the projectile 1800 including a first part or body 604, a second part or nose 610, a third part or lid 618, and fins 1802. Also shown are optional structurally weakening features, such as scorings, for example, latitudinal and longitudinal scorings 48 and 49. In this embodiment, the body 604 is generally hemispherical, similar to that of the nose 610. As such, the body and nose form approximately a sphere. The internal hollow portion 2116 (see FIG. 3) of the body 604 is configured to be similar to the internal portion of the nose 610 (as described above) providing a generally spherical internal cavity 2114 (not shown).

The fins 1802 may be individual fins that are attached, bonded, or molded to a portion of the projectile body, so as to help stabilize the projectile 1800 in flight in order to increase the range of the projectile 1800. The fins 1802 may be made of the same material as the projectile or other flexible material, such as rubber, urethane, polyethylene and other similar materials to withstand the launch loads without structurally failing. Furthermore, the fins 1802 may be individual fins or may be a single fin body including more than one fin 1802, for example, four fins 1802, that are attached or bonded to the projectile body 604. Note that although shown as a three-part projectile, the projectile 1800 may be a two-part projectile.

Figure 27:
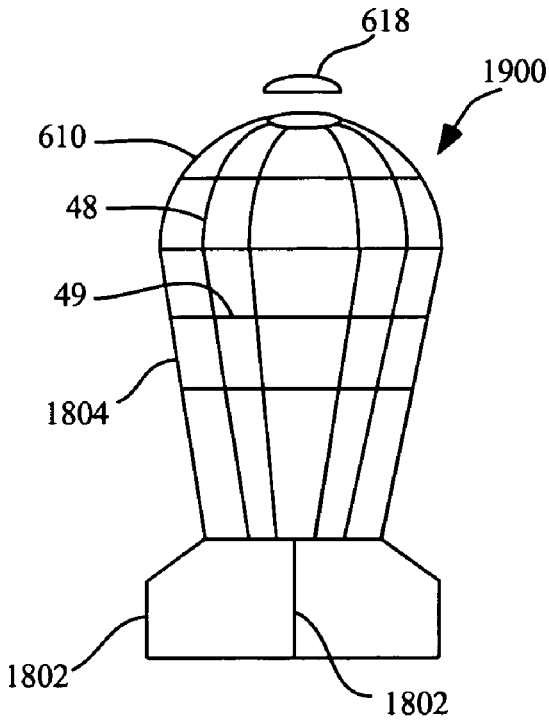
FIG. 27 depicts a side view of a variation of the projectiles of FIGS. 1-4 and 26, illustrating a three-part non-spherical projectile including stabilizing fins.

Referring next to FIG. 27, a side view is shown of a variation of the projectiles of FIGS. 1-4 and 16, illustrating a three-part non-spherical projectile in which a body 1804 of the projectile 1900 is an integrated body including stabilizing fins 1802. The projectile 1900 includes a nose 610, a lid 618, fins 1802, and an elongated and/or tapering body 1804. In some embodiments, the nose and body are formed as a single continuous piece. Also shown are optional structurally weakening features, such as scorings, for example, latitudinal and longitudinal scorings 48 and 49.

The body 1804 in this embodiment is modified so as to be integrated with the fins 1802 and is not hemispherical in shape. The modified body 1804 is illustrated as cup shaped and is configured to carry a larger payload of substance or material within the cavity of the projectile 1900 than the projectile 1800 of FIG. 26. Again, the fins 1802 add stability for a greater flight range as well as a greater payload of the projectile 1900.

Figure 28:
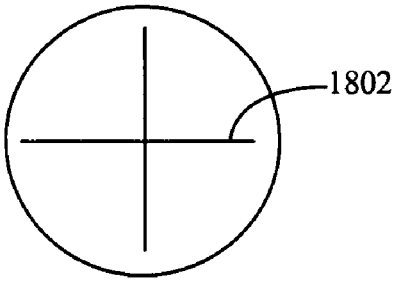
FIGS. 28 and 29 depict end views of variations of the stabilizing fins of FIGS. 1-4, 20, 26 and 27, illustrating straight fins and curved fins, respectively.
Figure 29:
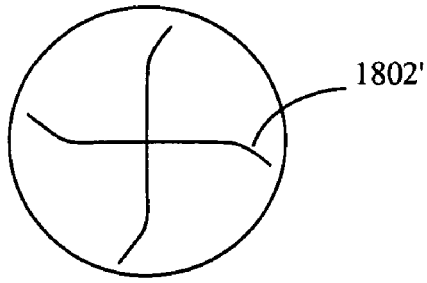

Referring next to FIGS. 28 and 29, end views are shown of variations of the stabilizing fins 1802 of FIGS. 1-4, 10, 16 and 17, illustrating straight fins 1802 and curved fins 1802', respectively. The view is, for example, looking up underneath the views as shown in FIGS. 26 and 27. In one embodiment, straight fins 1802 may be implemented to stabilize the flight of the projectile. In another embodiment, curved fins 1802' may be implemented that add an additional radial stability or spin stabilization to the projectile in flight.

Advantageously, the projectile systems contemplated herein are muzzle safe, that is they may be safely and effectively fired at close range, including, for example, at arm's length. In contrast, other long range non-lethal projectiles have not proven to be safe immediately outside a muzzle. A further important feature of the present projectile systems is that they are not only easy to manufacture in large quantities, but they are also very inexpensive compared with prior art projectiles.

The embodiments of FIGS. 28 and 29 can be fabricated in a manner substantially similar to the fabrication method illustrated in FIGS. 22 and 25.

Figure 30:
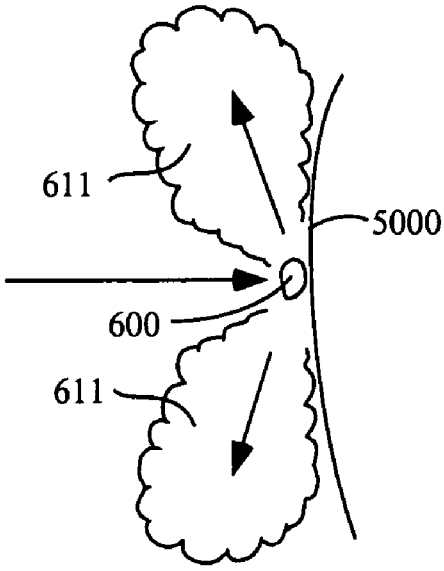
FIGS. 30 and 31 depict side views of the projectile systems of FIGS. 1-4, 16-18, 26 and 27 as they impact against a target.
Figure 31:
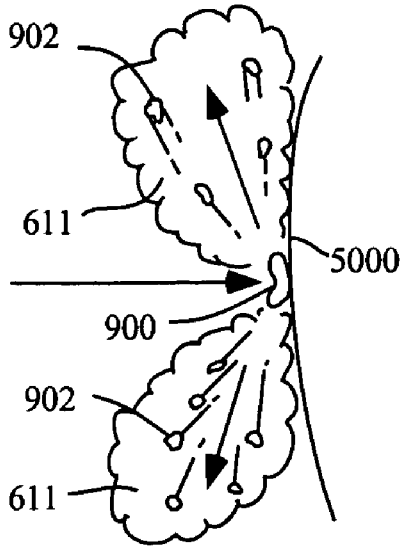

Referring to FIGS. 30 and 31, side views are shown of the projectile systems described and illustrated in FIGS. 1-4, 6-8, 16 and 17 as they impact against a target 5000. As can be seen, for example in FIG. 30, the optimal fill, described above, results in a wide dispersion of the substance 611, substantially radially away from the point of impact and away from an axis defined by the projectile's trajectory as it impacts the target.

Similarly, FIG. 31 illustrates an implementation of additional solid material or materials 902 that have been added to the substance to enhance dispersion. FIG. 31 shows the substance 611 and solid material 902 being projected radially with the substance 611, thereby driving the substance 611 more radially away from the projectile, and enhancing its dispersion pattern. (It is noted that the substance 611 is the same as 2111, 2111*a* and 2111*b*.) The solid material 902 may be, for example, crushed walnut shells, rice, metal particles, such as metal powder or filings, wood particles, such as wood shavings or wood dust, or any other readily available solid that can be added to the substance 605. Facts such as cost, density, and toxicity factor into selection of the solid material 902. Advantageously, the solid material 902 helps to disperse the substance 611 by carrying the substance quickly away from the point of impact in a generally radial (or lateral) direction.

Addition of a solid material can be made to the inhibiting substance of any of the projectiles depicted and/or described herein.

To further facilitate maximum dispersal of the contents of the projectile in a non-lethal projectile system, the substance should be formulated so that it is not strongly cohesive. For example, where a liquid substance is employed, it should be selected to have very low surface tension (or should be placed under pressure), and where powders are concerned, highly structured surfaces are to be avoided. Thus, for example corn starch is a smooth surfaced powder that will readily disperse in a cloud-like manner; whereas other powders may require micro-grinding to remove structured surfaces.

Various substances, well known to those of skill in the art, may be used in the present projectile systems. Particularly preferred herein, however, is a powdered capsaicinoid, capsaicinoids or oleoresin capsicum, which are pepper-derived substance, i.e., essentially a food product. When powdered oleoresin capsicum is delivered to a target, in accordance with the apparatus and methods described herein, the target inhales the substance into its lungs, which not only is painful to the target but also results in a temporary inability to breathe effectively. Although the inability to breathe is temporary, it is of sufficient duration to cause panic in the individual, thereby providing adequate time for apprehension. Furthermore, like the liquid form, powdered oleoresin capsicum causes significant irritation and pain when it contacts the mucous membranes, such as for example, eyes, nose, mouth or throat, of a living target.

Referring back to FIG. 31, the solids 902 can be metal filings, such as iron, steel, tungsten or bismuth filings, added to and intermixed with the substance 611. Alternatively, any of the previously mentioned solid substances, including for example metal powders, such as powdered iron, steel, tungsten or bismuth, may be used in lieu of the metal filings. The metal filings function in a manner similar to the manner in which the solid material 902 functions in that, upon impact, the metal filings, being more dense than the substance 611 are flung radially, thereby breaking up the substance, atomizing the substance and carrying the substance radially, perhaps further than the substance would be dispersed absent the metal filings.

In addition, the metal filings increase the mass of the projectile, thereby increasing the kinetic force applied by the projectile against the target upon impact of the projectile against the target. As a result, the variation shown may offer as an advantage, not only enhanced inhibiting of a target, due to a more widely dispersed cloud of inhibiting substance, but also enhanced kinetic "thumping" against the target, thereby increasing the initial stunning blow delivered by the projectile. This increase in kinetic force may also enhance the ability of the projectile to leave a bruise on the target, thereby enhancing the projectile's ability to serve not only as a tool for inhibiting a target, but also as an evidentiary tool, should doubt arise as to whether a certain individual is one that has been hit by a projectile of the embodiments specified herein.

Furthermore, the "thumping" from the impact of the projectile should be with a sufficient force to temporarily stun the target, e.g. at least 2 to 3 ft-lbs of force for a human target, preferably at 6 ft-lbs, and most preferably at least 10 ft-lbs of force, which slows the target and allows the inhibiting substance to work more effectively. In comparison a typical paint ball impacts at about 10 ft-lbs of force and a non-lethal bean bag type projectile impacts at about 120 ft-lbs (i.e. at about 90 mph).

The present projectile can be used against human and animal targets. Further, the projectiles can be used defensively or offensively. Some situations where the projectile can advantageously be used include hostage situations, domestic disturbance situations, riot control, vehicle extraction, fleeing suspects, suicide by police, armed suspects, and other situations where non-lethal force would be advantageous.

Figure 32:
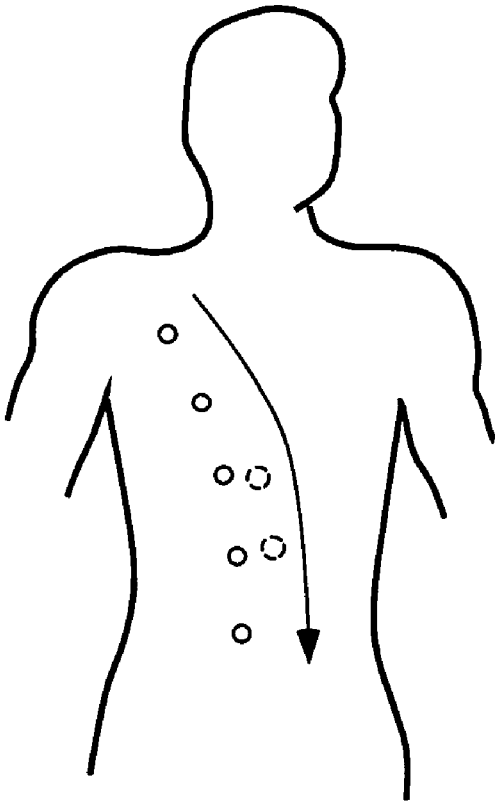
FIG. 32 is a frontal view of a human target with a preferred firing pattern, for the projectile systems herein, illustrated on his/her body.
Figure 33:
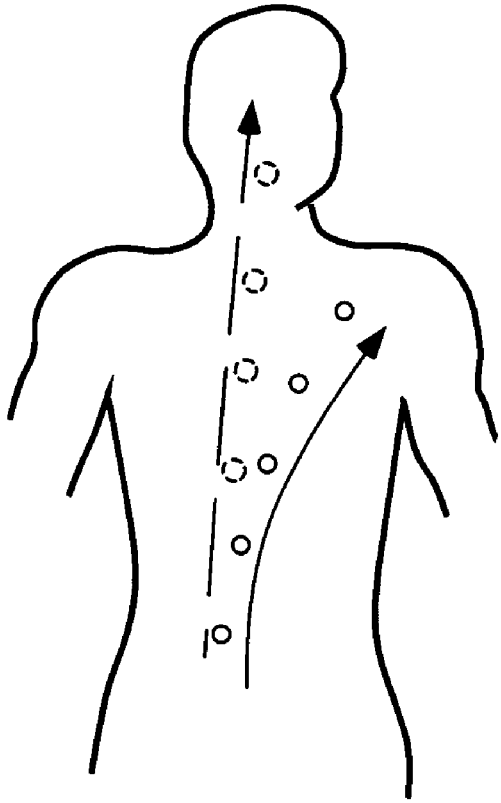
FIG. 33 is a frontal view of a human target with two alternatively preferred firing patterns, for the projectile systems herein, illustrated on his/her body.

Referring next to FIGS. 32 and 33, front views are shown of various firing patterns that may be used when firing the projectiles of the present embodiment, which firing patterns offer particular advantages when used in combination with the projectile systems described herein and with rapid firing techniques.

Figure 40:
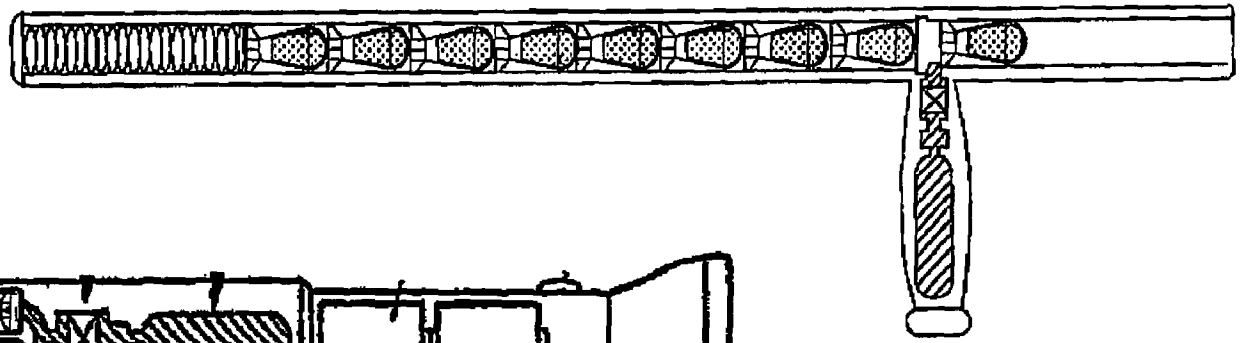
FIG. 40 is a cross-sectional view of a launch device useable in combination with a projectile for delivering an inhibiting substance to a living target, wherein the launch device assumes the form of a PR24 police baton thus allowing dual use of the launch device, i.e., as a launch device and as a PR24 police baton.
Figure 41:
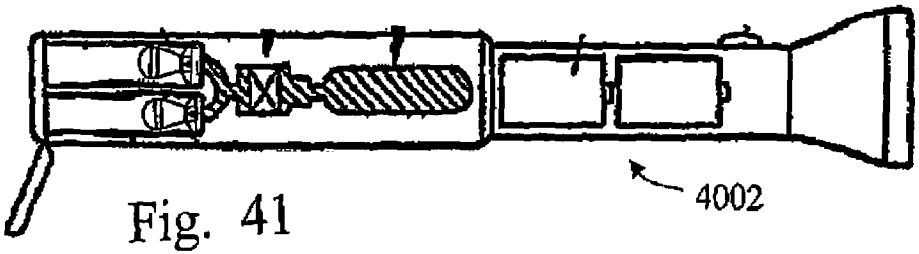
FIG. 41 depicts a projectile system for use in delivering a substance to a target that includes a plurality of projectiles and modified flashlight launch device capable of launching one or more of the plurality of projectiles.
Figure 42:
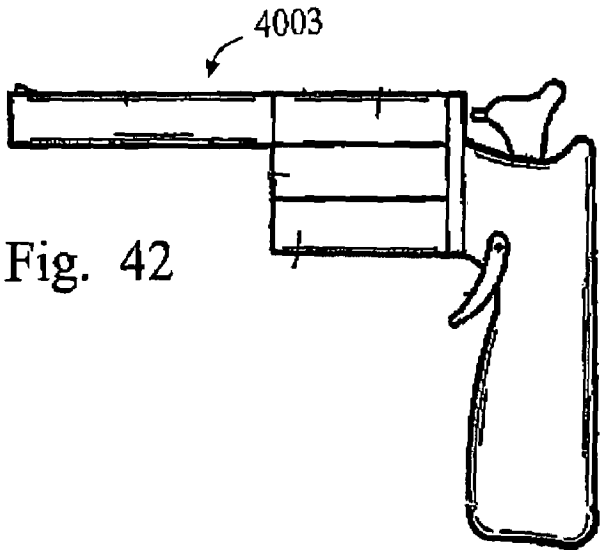
FIG. 42 depicts a projectile system for use in delivering a substance to a target that includes an air pistol launch device capable of launching one or more of the plurality of projectiles depicted in FIG. 1.

Quite advantageously1 the projectile system of the present embodiment may be rapid fired, for example referring to FIGS. 40-42, using a compressed air pistol 4003, compressed air rifle, a fully automatic launcher, a dual-use modified PR24 police baton 4001, a dual-use modified flashlight 4002, a shotgun, and/or other similar rapid fire devices.

A rapid fire weapon can be rapidly fired in a vertical direction, such as illustrated in FIG. 32, from the top (superior region) of the target's torso, for example, near his/her shoulder, down to the bottom (inferior region) of the torso and body, for example, near his/her groin. It has been discovered, by the inventors, that this firing method exploits the targets tendency to retract to a stricken portion of their body, and to follow (i.e., hunch around) a pattern of impacts, thereby resulting in the target moving his/her body ever more downward and into the dispersing substance, resulting in maximum incapacitation of the target. In this instance, the target moves in a manner similar to that shown in FIGS. 34 through 36 (as described fully below), however, the movement of the target's head into the cloud is even more dramatic when the illustrated rapid firing method is employed (see FIG. 32). Note that while the rapid firing method has been discovered to offer particular. advantages, traditional wisdom dictates a horizontal sweeping of the target's body with projectile impacts. The inventors are aware of no heretofore employed methods that specify vertical sweeping of a target's body with non-lethal or less-than-lethal projectiles.

Referring next to FIG. 33, a front view of a target, similar to that of FIG. 28, is shown. In this variation, however, the pattern of projectile impacts move from the lower (inferior region) of the target's torso/body up to the top (superior region) of the torso/body, e.g., from the target's groin area towards either the target's shoulder or head, with the "head pattern" being shown in dashed lines.

The variation illustrated in FIG. 33 is particularly advantageous in highly volatile, highly dangerous situations, such as when confronting targets under the influence of powerful drugs. While normally use of non-lethal projectiles would dictate that a target's head be avoided as a target area, this firing pattern provides a user with an option to move the projectile impact pattern to the target's head in the even that all other efforts fail to subdue the target. If, on the other hand, the target is subdued, the firing pattern can move safely to the target's shoulder. The inventors contemplate that this pattern of projectile impacts will be slightly less effective in getting a target to move his or her head into the cloud of substance; however, it does offer the advantage of providing a severe option, when, for example, deadly force would be justified.

Figure 34:
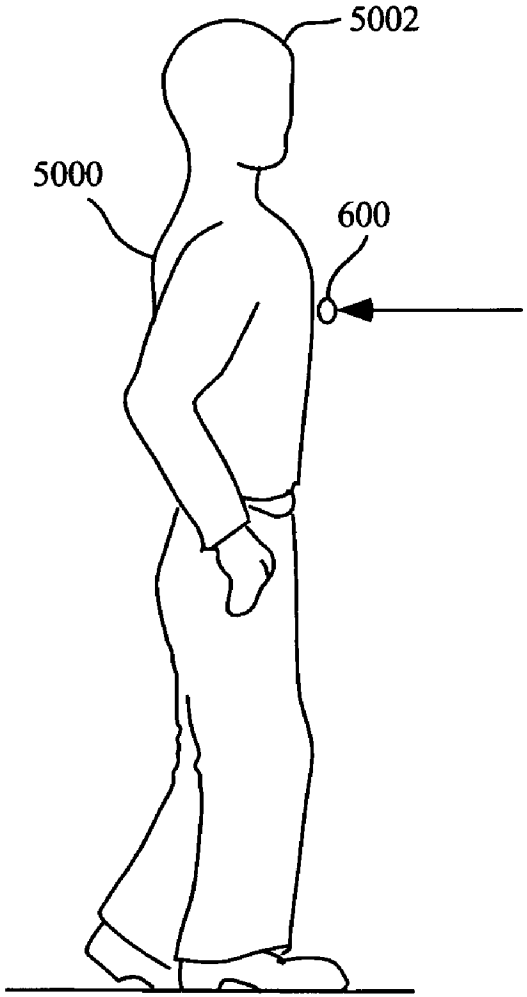
FIGS. 34, 35 and 36 are a sequence of profile views of a human target as he/she is impacted with a projectile system in accordance herewith.
Figure 35:
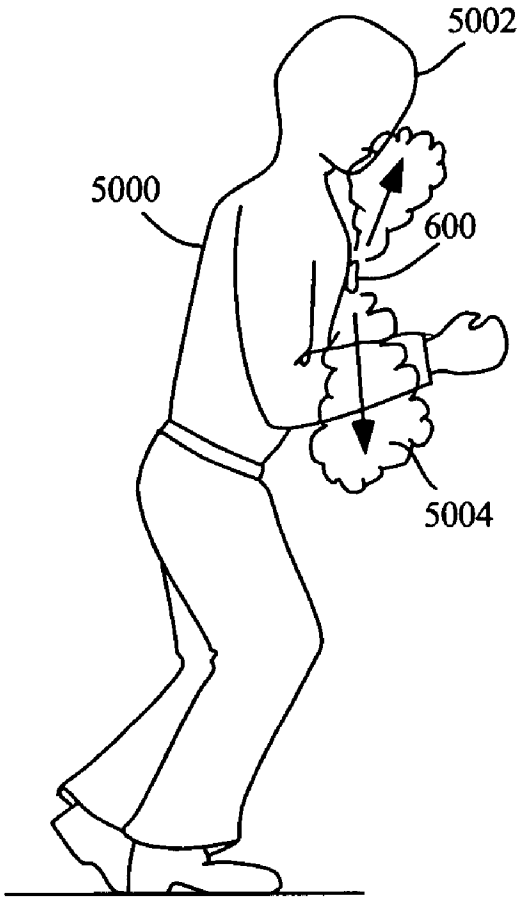
Figure 36:
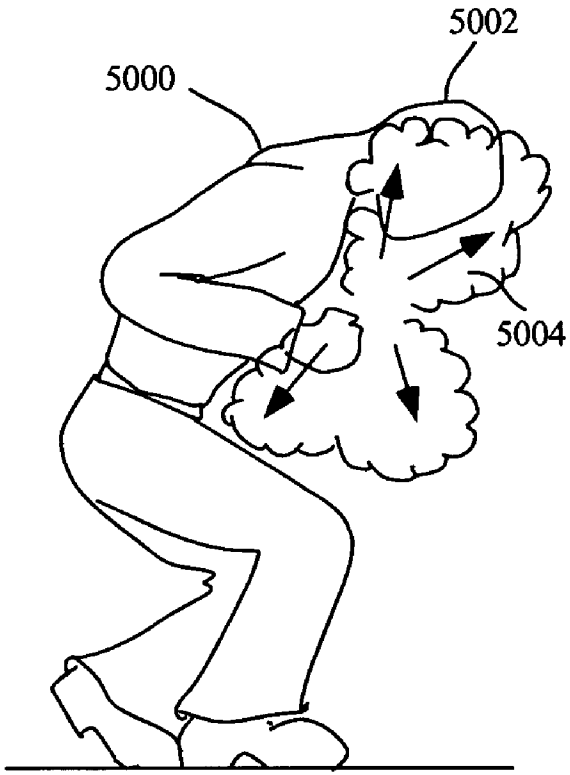

Referring to FIGS. 34 through 36, a sequence of profile views are shown of a target 5000, the target is impacted with a projectile system 600 of the present embodiment. In FIG. 34, the target 5000 is first impacted with a projectile system 600 of the present embodiment. The target's head 5002, at the time of impact, is illustrated as in a generally upright forward-looking position. Nearly immediately upon impact, the capsule of the projectile system ruptures, dispersing its contents 5004 in a radial, cloud-like manner on and about the target 5000 and radially away from the point of impact. About simultaneously with dispersal of the contents 5004 of the capsule, the target 5000 begins to hunch towards the point of impact of the capsule on his/her body in reaction to the impact (see FIG. 35). Thus, the target's back side moves in a generally posterior (rearward) direction, while his/her head and upper chest region move in a generally anterior (forward) and inferior (down) direction so as to hunch around the point of impact. Quite advantageously for the purposes of the present embodiment, such movement is a natural reaction for people when they are hit by something with such force.

Within a matter of seconds, and as illustrated in FIG. 36, the target's head 5002 is essentially surrounded by the dispersing cloud of inhibiting and/or marking substance 5004. Where an inhibiting substance is employed, the target 5000 will feel pain as the inhibiting substance contacts his/her mucous membranes (i.e., his/her eyes, nose, mouth and throat), and as the target inhales the substance (also a natural reaction), he/she will experience significant pain in his/her lungs, will temporarily be unable to breathe and will begin to panic. Under such circumstances, even the most aggressive target is easily subdued and apprehended. Thus, the target's movements, in response to impact of the projectile, combined with the radial dispersement of the substance on and about the target, provides a particularly effective non-lethal inhibition of the target.

This present embodiment, then, provides a method of slowing and/or stopping and/or marking a living target. According to this method, the projectile system is fired at a target; the mechanical force of the impact causes rupture of the capsule, thereby permitting dispersal of the capsule contents, additionally, the force is sufficient to cause the target to move towards the dispersing substance, resulting in inhalation of the same, as the target attempts to catch his/her breath following the impact. As the substance is inhaled and/or contacts the mucous membranes in the face region, the target is stunned, that is physically impaired, and thus, collapses.

Further contemplated herein, is providing a projectile system wherein the projectile, is sufficiently hard and is delivered with sufficient force to result in bruising of the target at and surrounding the point of impact. In this way, the target is not only exposed to an inhibiting substance, but is also temporarily marked for later identification. For example, if any confusion arises as to who has been hit by the non-lethal projectiles, such as where the target is able to recover from or escape the effects of the inhibiting substance before officers are able to apprehend him/her, then the target may later be identified by the bruising, should he/she ultimately be apprehended. Those of skill in the art, will readily appreciate that the force required to fire a projectile system in accordance herewith, at a target, such that the projectile ruptures upon impact with the target, will generally also be sufficient to cause bruising to the target. It will further be appreciated by those of skill in the art that the capsules of the present embodiment may alone be used to mark a target, by bruising of the same, with or without delivery of any substances.

Figure 37:
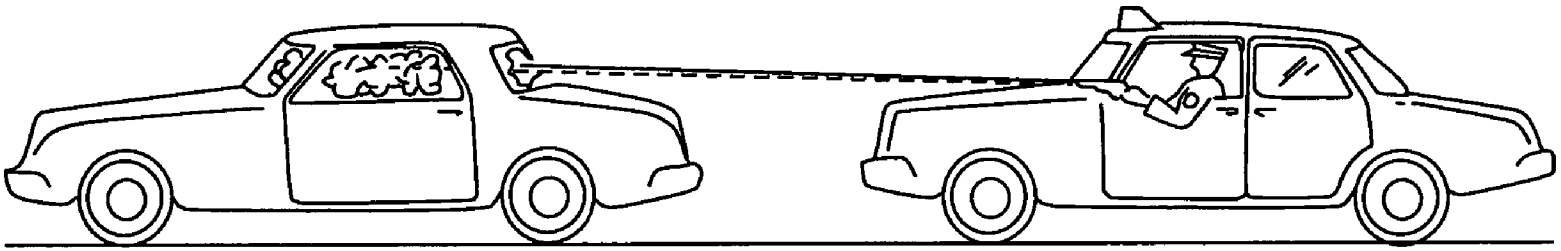
FIG. 37 is a side view of a tactic, contemplated herein, for stopping a car under chase using the projectile systems described herein.

Referring next to FIG. 37, a side view is shown of a tactic for stopping a car under chase. Contemplated herein is loading a weapon with both impairing capsules and kinetic capsules, that is, respectively, frangible capsules containing an inhibiting and/or marking substance and frangible capsules that are hollow or that contain an inert substance. Alternatively, breaker balls, e.g., stainless steel, tungsten, bismuth, ceramic, plastic or glass balls, contained in a frangible capsule in accordance herewith, may be substituted for kinetic capsules.

Thus, for example, as the weapon is rapid fired at a suspected criminal who is within a vehicle, the first rounds of capsules would be kinetic capsules or breaker balls that simply break the windows (solid line shows trajectory) of the vehicle to facilitate entry of the subsequent, impairing capsules that would then fill the vehicle (dashed line shown trajectory), at least in the vicinity of the criminal, with the inhibiting substance, thereby rendering the target unable to operate his or her vehicle.

Figure 38:
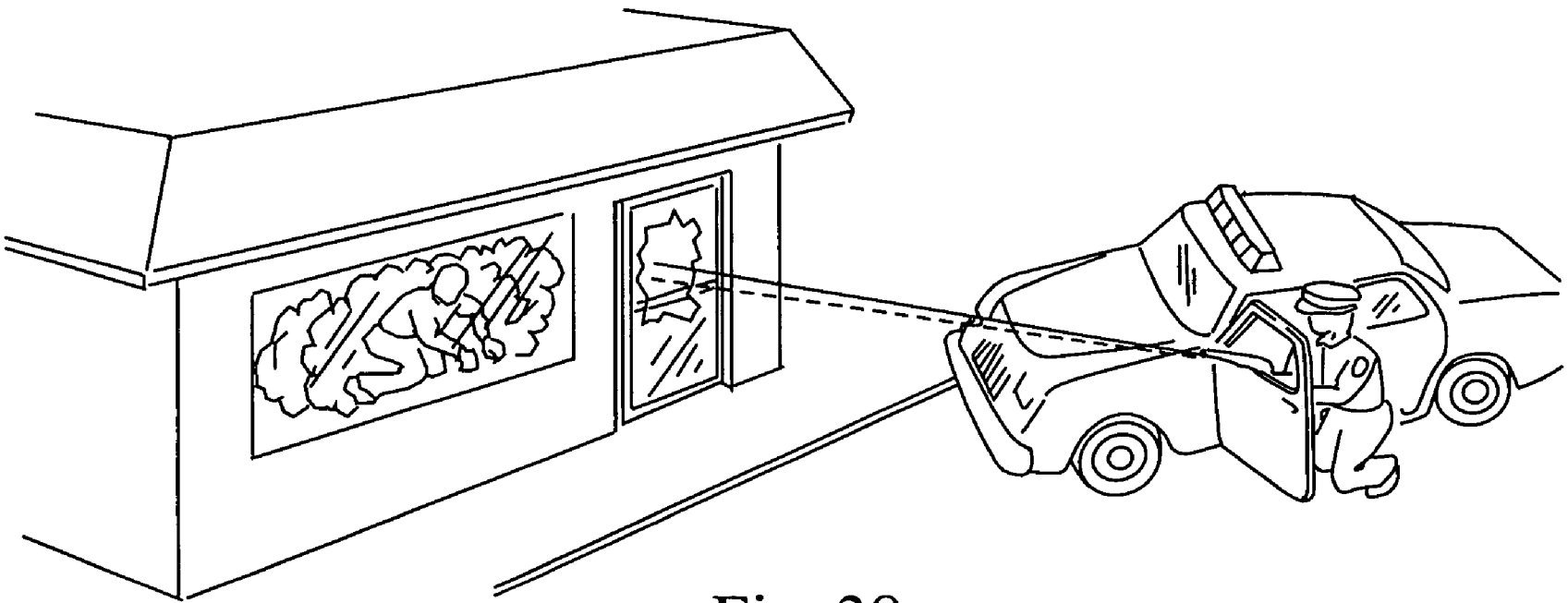
FIG. 38 is a perspective view of a further tactic contemplated herein, for delivering projectile systems in accordance herewith, to a target within a building.

Referring next to FIG. 38, a perspective view of a tactic for delivering an inhibiting substance to a target within a building is shown. As with the tactic above, an initial one or more kinetic capsules are used to break glass or other glass-like, i.e. frangible, material of the building, such as, for example, acrylic, plexi-glass or the like. These "glass-breaker" capsules are followed by impairing capsules that deliver the inhibiting substance to the target. Again, as with the tactic described with respect to FIG. 37, frangible capsules in accordance herewith, containing breaker balls may be employed as the first round of projectile systems in order to break the glass-like barrier behind which the target is located.

Advantageously, the impairing capsules need not actually impact the target to be effective. Specifically, so long as the capsules impact sufficiently near the target that the cloud is inhaled by the target, or otherwise affects the target's respiration or other mucus membranes, such capsules will be effective at achieving their intended purpose, i.e., inhibiting or impairing the target. Thus, for example, where an animal, such as a dog or large cat, e.g. mountain lion, is being targeted, the capsules, in accordance herewith, may be impacted on the ground near the animal's face or on another object near the animal's head or may be targeted directly to the animal's head or body. In this case, (except, perhaps where the animal's head is targeted) the present embodiment provides a non-lethal means for subduing an animal that may pose a danger to humans or that may be in need of assistance itself.

Thus, in accordance with the present aspect, and quite advantageously, the projectile systems, because their dispersal mechanism is so optimized, may be used to inhibit a target when the target cannot actually be targeted. By way of further example, an individual hiding within a bathroom stall cannot be seen and thus for law enforcement personnel to attempt to confront the individual could place the law enforcement personnel in great danger. However, with the projectile systems of the present system, the officer need simply fire the projectiles at the wall above the stall within which the target is hiding or at a solid object near the target individual. The capsules of the system will rupture and the contents thereof will waft down into the stall, where they will be inhaled by the target and/or contact the target's mucous membranes, thereby incapacitating him/her. In fact, the inventors have tested this scenario using the projectiles of the present embodiment and have found the results to be quite impressive. The individual could not escape the effects of the inhibiting substance and was well incapacitated thereby.

In any case, absent a solution to the problem of residual inhibiting substance or irritant, it is highly questionable whether any law enforcement or military agency (particularly law enforcement agency) would adopt a powder-filled projectile as a non-lethal or less-than-lethal solution. Presently, all commercially viable non-lethal or less-than-lethal approach used by law enforcement and the military, at least to the best of the inventors' knowledge, either do not employ a chemical irritant, or employ a gas, which is diluted and carried away by ambient air currents. In the case of tear gas, however, for example, residual tear gas is a significant problem for personnel operating in an area after tear gas has been deployed.

For example, if medical personnel are needed in an area, they are required to wear a breathing apparatus, such as a gas mask, following the use a tear gas, at least until an area can be vented. With the present approach, however, an area can be sealed with hair spray or another spray adhesive following use of a powdered irritant projectile, after which personnel, such as medical personnel, can operate in the area almost immediately without the need for cumbersome and awkward breathing apparatuses with which such personnel may not have any training. Further, if, for example, mouth-to-mouth resuscitation needs to be performed, the present technology allows medical or law enforcement personnel to perform this type of resuscitation without first moving a victim out of an area contaminated by an inhibiting substance. Thus, the ability to seal both a target and an area around a target following use of the projectiles described herein provides a significant, and heretofore unaddressed, solution to a very real problem with heretofore available non-lethal or less-than-lethal projectiles that employ a chemical inhibiting substance or irritant.

Figure 39:
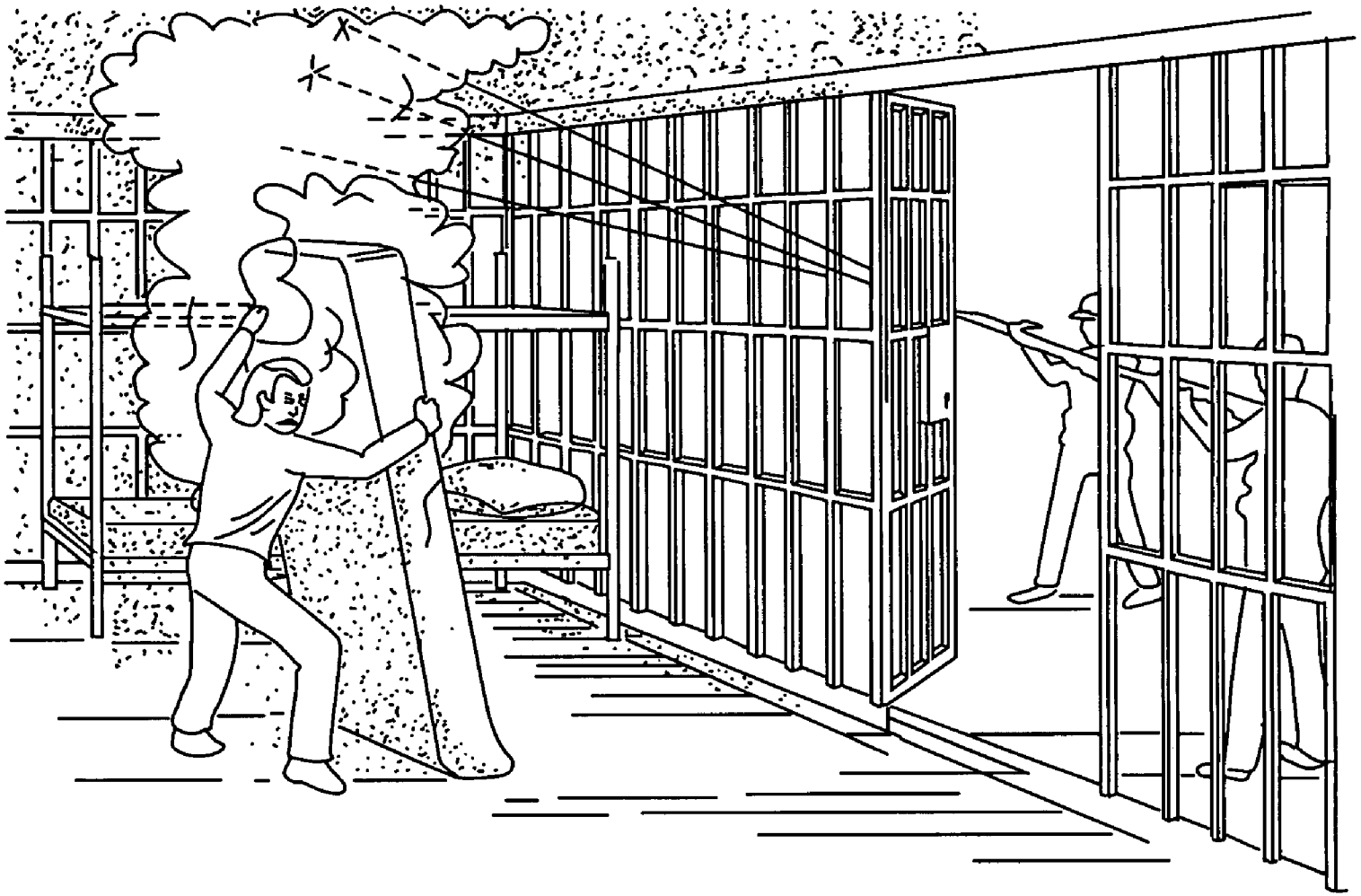
FIG. 39 is a perspective view of a further tactic contemplated herein, for delivering projectile systems and inhibiting a target, for example, by impacting an object, such as a ceiling, near the target.

Next referring to FIG. 39, a perspective view is shown of a further tactic contemplated herein, for delivering projectile systems and inhibiting a target, for example, by impacting an object, such as a ceiling, near the target.

Shown in FIG. 39 is a person to be inhibited by the projectile system, and law enforcement, launching non-lethal projectiles at and impacting an object or target near the person. For example, in a prison riot, or in a cell extraction, prisoners may barricade themselves or hide behind objects, such as the mattress shown, such that it is difficult for an officer to directly hit the prisoner with a projectile system, without risking injury or attack. In practice, the officer impacts an area near the prisoner, for example, the ceiling above the prisoner. The resulting dispersed "cloud" containing one or more inhibiting substances expands such that the substance is inhaled into the prisoner's lungs. Shortly thereafter, typically within seconds, the prisoner is inhibited.

For example, the prisoner is temporarily unable to breath, which will typically cause the prisoner to panic and fall to the ground. This allows the officers ample time to subdue and control the prisoner. Advantageously, even though the prisoner is obstructed from direct view by the object, for example, by the mattress, the projectile system can effectively inhibit the prisoner by impacting one or more projectile systems at a target near the prisoner. Firing multiple projectile system further enhances the "cloud" of dispersed substances.

This tactic applies to any situation where a suspect is not in a direct line of fire with law enforcement. For example, the suspect may be hiding behind a wall, or within a bathroom stall. The officer merely shoots the projectile systems at a target near the suspect, e.g. a ceiling or a bathroom stall wall, and waits for the resulting finely dispersed cloud containing an inhibiting powder, for example, a powdered oleoresin capsicum or a powdered capsaicin, expands to enter the suspects lungs. Thus, the suspect is effectively inhibited without actually impacting the suspect.

Furthermore, this tactic may apply to inhibit a living animal, such as dog or other animal that may be hiding out of a direct line of fire, for example, behind a rock. The projectiles used may be any of the projectiles as described above, although in this application, powder containing substances are preferable.

Further examples of applications and tactics for use are shown and described in U.S. Pat. Nos.: 5,965,839 and 6,393,992, and U.S. patent application Ser. Nos. 09/543,289 filed on Apr. 5, 2000, 10/146,013 filed on Apr. 14, 2002, and 10/208,727 filed on Jul. 29, 2002 each fully incorporated earlier by reference.

The present embodiments solve many of the significant disadvantages in many prior art devices. For example, one of the disadvantages of many prior devices is that they do not take into consideration the need to deliver an inhibiting (or active) substance under fairly precise dispersal conditions to insure effectiveness thereof. When a target is impacted with a projectile delivering a substance thereto, to be maximally effective, the substance should disperse in a generally radial manner (or transverse to the motion of the projectile) such that the target's face is quickly and fully contacted thereby as provided by the present embodiments.

The present embodiments, at the same time, can be aimed with a degree of precision so as to be able to avoid hitting the target in, for example, the face. Further, the present embodiment provides sufficient dispersion of the inhibiting substance so that, for example, a projectile impacting on a target's chest delivers inhibiting substance to the target's face where it can be effective. Many prior projectiles, not only rarely contemplate these problems, but also frequently fail to provide for dispersal of the inhibiting substance to a target's face after impacting the target at a remote area.

More specifically, for example, while powdered inhibiting substances, in the view of the inventors, offer distinct advantages over the vast majority of prior devices that deliver inhibiting substances to a target, most prior devices fail to address the problem of both accurately delivering the projectile to the target at a location remote from the target's face, and dispersing a powered inhibiting substance in a cloud-like, radial manner so as to assure that the powdered inhibiting substance reaches the target's face. The present embodiments is capable of providing tactical advantages with non-lethal or less-than-lethal projectiles that can be accurately delivered to a target, impacting the target in an area other than the target's face, while at the same time providing dispersal of a powdered inhibiting substance to the target's face, where it is effective.

The present embodiments are both sufficiently safe to be used at close range and, at the same time, effective at longer ranges, such as 10 feet or more, e.g., 20 or 30 feet or more. Most non-lethal weapons heretofore known, however, are either operated at close ranges, for example, pepper spray canisters, or operated at long ranges, for example, rubber bullet devices, but do not operate at both close and long ranges. In particular, the close range weapons are generally not deployed with sufficient force to travel further than a few meters, and the longer range weapons generally are not "muzzle safe" in that they cannot be safely deployed at very short distances because of the chemical/explosive nature of the launching mechanism. As a result, law enforcement and military personnel are often required to employ two different technologies, one for close range applications, and another for long range applications.

In being able to use a single device for both applications the present embodiments provide numerous advantages. For example, cost is a significant factor recognized universally by governmental agencies, but perhaps even more importantly is a tactical disadvantage imposed by the use of both short range and long range non-lethal or less-than-lethal technologies. Many available technologies require that a user make a decision as to whether a particular situation calls for a short range non-lethal technology or a long range non-lethal technology. This requires not only spending time to assess a situation in order to determine whether non-lethal or lethal technology should be employed, but also requires expenditure of more time determining which non-lethal technology is appropriate, that is whether the situation calls for short-range technology or long-range technology. As a result, non-lethal and less-than-lethal projectiles are rarely used by law enforcement and military personnel, and, when used, are generally used only in situations where sufficient time exists for the user to make the chain of decisions necessary to first select non-lethal technology and second, to select what range of non-lethal technology is appropriate.

Cost becomes an important consideration in these tactical issues as well. Because two types of non-lethal technology must, using previous technologies, be available, many, if not most, law enforcement and military agencies cannot afford to fully equip their personnel. This cost constraint is further exacerbated because heretofore available non-lethal technologies, at least the ones that are effective, and thus actually useable, are complicated and highly specialized and most non-lethal devices do not offer a low-cost inert training version. Training is costly and therefore, use is infrequent. As a result, the actual costs of previous devices are still prohibitive and therefore dictates only limited deployment.

The present embodiments provide a cost effective and highly versatile apparatus and method for dispersing inhibiting substances. Further, the present embodiments allow for accurate and rapid dispersement. Still further, the present embodiments allow the projectiles to be directed at objects other than the target while still achieving sufficient dispersement of the inhibiting-substance to affect the intended target. Additionally, because the present embodiments can be used at both close and long range, only a single device is needed. This significantly reduces cost for both equipment as well as training.

The present embodiments provide muzzle safe projectiles and/or systems that provide optimum dispersal of the substances contained therein. Further, projectile and/or systems can be readily incorporated into existing officer training programs, so that officers can be quickly, cost effectively, and easily trained in the use of the projectiles and/or system, which, in turn would be of particular advantage to the officer when attempting to use the system under stressful situations, as would normally be the case. Additionally, the present projectiles impact a living target in such a way as to actually facilitate the effectiveness of the system.

While the invention herein disclosed has been described by means of specific embodiments and applications thereof, numerous modifications and variations could be made thereto by those skilled in the art without departing from the scope of the invention as set forth in the claims.

What is claimed is:

1. A projectile system for use in delivering a substance to a target, comprising:

a projectile comprising:

a first part;

a second part that is at least partially hollow, wherein the second part is secured with the first part to seal the hollow portion defining a volume, wherein the projectile is non-spherical;

an inhibiting substance contained within the volume; and stabilizing fins secured with the second part along an exterior of the second part; and a propulsion block positioned proximate to the stabilizing fins and configured to maintain substantially all of a propulsion force behind the propulsion block and to evenly distribute the propulsion force to the projectile;

wherein the inhibiting substance is dispersed into a cloud upon impact of the projectile with a target;

wherein the second part comprises a body portion removably secured with a tail portion; and wherein the body portion tapers to a smaller diameter away from the first part and comprises a tongue, and the tail portion comprises the stabilizing fins and a receiving port that mates with the tongue of the body portion securing the body portion with the tail portion.

2. The projectile system of claim 1, wherein the first part comprising a fill hole cooperated with the volume and a lid secured within the fill hole sealing the fill hole.

3. The projectile system of claim 2, wherein the body portion comprises weakening features to aid in the rupture of the body.

4. A projectile system for use in delivering a substance to a target, comprising:

a projectile comprising:

a first pat;

a second part that is at least partially hollow, wherein the second part is secured with the first part to seal the hollow portion defining a volume, wherein the projectile is non-spherical;

an inhibiting substance contained within the volume; and stabilizing fins secured with the second part along an exterior of the second pat and a propulsion block positioned proximate to the stabilizing fins and configured to maintain substantially all of a propulsion force behind the propulsion block and to evenly distribute the propulsion force to the projectile;

wherein the inhibiting substance is dispersed into a cloud upon impact of the projectile with a target;and wherein the propulsion block comprises a plate closing a first end of the propulsion block and configured to be positioned proximate the projectile, and a plurality of rings separated and positioned along a length of the block where the plurality of rings extend around a perimeter of an exterior of the propulsion block and radially away from a central axis of the propulsion block with each ring configured to establish a seal that aids in maintaining substantially all of the propulsion force behind the propulsion block and evenly distributed to the projectile.

5. The projectile system of claim 4, further comprising:

a shell within which the projectile and the propulsion block are positioned prior to launch with the rings of the propulsion block establishing the seals against the shell.

6. The projectile system of claim 5, wherein the propulsion block comprises a flexible lip extending radially and circumferentially about an exterior of the propulsion block, where the lip defines a diameter that is greater than a diameter of the shell when the propulsion block is external to the shell and the lip flexes when the propulsion block is positioned within the shell such that the lip establishes a seal with the shell.

7. The projectile system of claim 6, wherein the plate extends beyond a cylindrical portion of the propulsion block and establishes a seal with the shell.

8. The projectile system of claim 7, wherein the second part comprises a body portion removably secured with a tail portion, where the body portion tapers to a smaller diameter away from the first part and comprises a tongue, and the tail portion comprises the stabilizing fins and a receiving port that mates with the tongue of the body portion securing the body portion with the tail portion; and the first part further comprises a fill hole cooperated with the volume and a lid secured within the fill hole closing the fill hole and the volume.

9. A projectile system for use in delivering a substance to a target, comprising:

a projectile comprising:

a first part;

a second part that is at least partially hollow and further comprises a tapered tongue, wherein the second part is secured with the first part to seal the hollow portion defining a volume, wherein the projectile is non-spherical;

an inhibiting substance contained within the volume; and a third part comprising stabilizing fins secured along an exterior of the second part and a receiving port that mates with the tapered tongue; and wherein the inhibiting substance is dispersed into a cloud upon impact of the projectile with a target.

* * * * *

UNITED STATES PATENT AND TRADEMARK OFFICE

CERTIFICATE OF CORRECTION

PATENT NO. : 7,526,998 B2
APPLICATION NO. : 10/731684
DATED : May 5, 2009
INVENTOR(S) : Vasel et al.

It is certified that error appears in the above-identified patent and that said Letters Patent is hereby corrected as shown below:

Claim 4, column 29, lines 37 and 45, delete “pat;” and insert --part;--.
Claim 4, column 29, line 51, delete “target;and” and insert --target; and--.

Signed and Sealed this

Eighteenth Day of August, 2009

David J. Kappos

David J. Kappos
*Director of the United States Patent and Trademark Office*